United States Patent [19]

Peters et al.

[11] 4,040,510

[45] Aug. 9, 1977

[54] STAMP VENDING MACHINE

[75] Inventors: Walter A. Peters, Schaumburg; Curtis A. Hozian, Wheeling; Richard W. Gusek, Chicago, all of Ill.

[73] Assignee: Gard, Inc., Niles, Ill.

[21] Appl. No.: 697,024

[22] Filed: June 17, 1976

[51] Int. Cl.[2] ..... G07F 11/68

[52] U.S. Cl. ..... 194/2; 194/1 N; 194/10; 133/2; 221/93

[58] Field of Search ..... 221/93, 94; 133/2; 194/1 N, 2, 9, 10

[56] References Cited

U.S. PATENT DOCUMENTS

| | | | |
|---|---|---|---|
| 3,420,987 | 1/1969 | Houle | 194/1 N |
| 3,548,991 | 12/1970 | Flubacker | 194/10 |
| 3,655,109 | 4/1972 | Stevens | 226/46 |
| 3,894,220 | 7/1975 | Levasseur | 194/1 N X |

*Primary Examiner*—Robert B. Reeves
*Assistant Examiner*—Joseph J. Rolla
*Attorney, Agent, or Firm*—Claron N. White

[57] ABSTRACT

A stamp vending machine has a number of stamp dispensing mechanisms. Each mechanism is capable of dispensing one or more stamps of the same denomination. The machine can dispense from one mechanism different numbers of stamps and from a number of different mechanisms stamps of different denominations in various combinations totalling the same price or different prices. This capability is provided in a programmable manner that is easily changed to other combinations of numbers of the same stamps or to the operation of different combinations of stamp dispensing mechanisms. The construction of the machine preferably includes the capability of providing a backup of one of its stamp dispensing mechanisms by another mechanism or by more than one mechanism in sequence. The machine includes a main control logic having programming networks that permit the manual initiation of operation of the machine by a selection of a particular combination of stamps so that one or more stamp dispensing mechanisms of the machine are operated to dispense stamps, illustratively up to six different denominations, from these stamp dispensing mechanisms in a number of each denomination that provide a total value of dispensed stamps corresponding to the value of the stamp selection.

11 Claims, 9 Drawing Figures

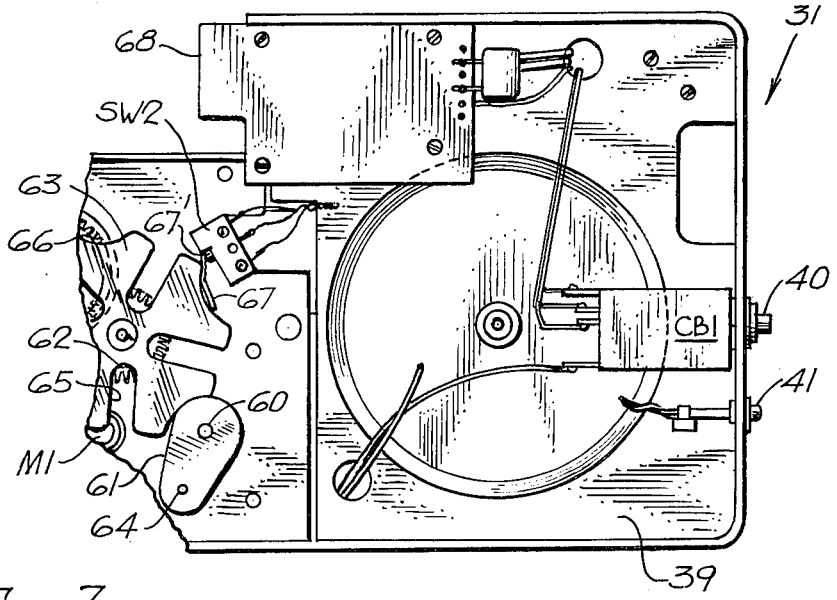
FIG. 3
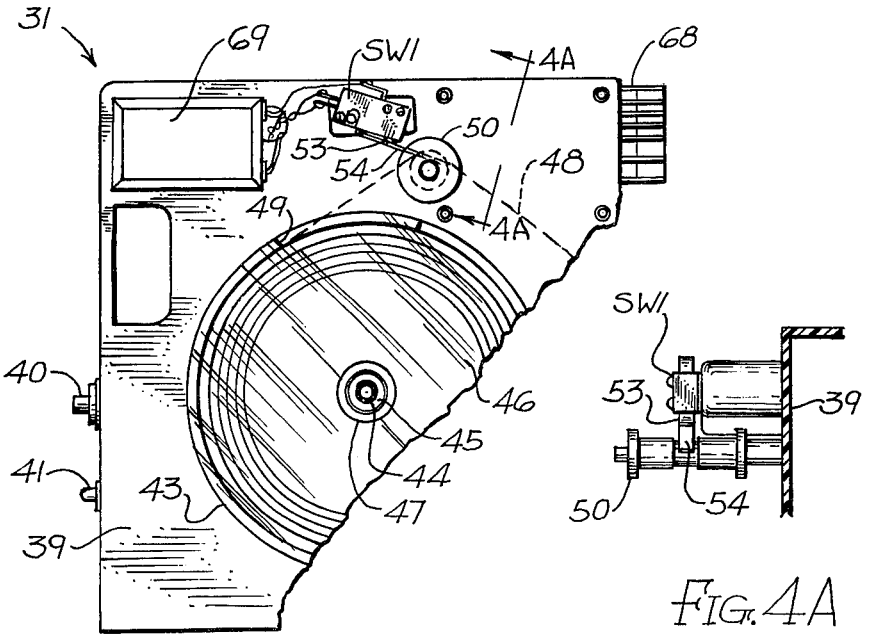
FIG. 4A
FIG. 4

12V
L150
L4'
152
69
L155
151
153
L158
L156
144
SW2
L161
L162
L160
146
L159
L163
L157
145
L164
Vcc
L108
L50
L51
L52
L53
131
132
133
134
135
L125
136
L126
137
L127
L128
138
L107
L123
L124
L122
L121
143
DC
L134
L132
L129
L130
L131
141
139
140
142
CB1
L28
L144
M1
L31
148
L141
149
L137
147
L136
L133
L143
L142
L138
L135
L145
L146
L151
L152
SW1
L4
41
L147
L148
L139
L136'
L154
150
L153
L149

STAMP VENDING MACHINE

CROSS REFERENCE TO RELATED APPLICATION

This invention preferably uses, for each stamp dispensing module, the stamp dispensing mechanism that is described and claimed in patent application Ser. No. 679,025 by Charles G. Middleton and Vincent F. Volpe and entitled, "Stamp Dispensing Mechanism and Geneva Drive System Therefor" being filed with this patent application.

BACKGROUND OF THE INVENTION

1. Field of the Invention

The invention relates to a stamp vending machine that operates, based on a manual selection, one or more stamp dispensing mechanisms to dispense stamps from rolls of stamps mounted on the stamp dispensing mechanisms.

2. Description of the Prior Art

A number of U.S. patents have been granted for stamp vending machines that have more than one stamp dispensing mechanism. Illustrative patents are U.S. Pat. Nos. 3,548,991 and 3,655,109. Each machine of these patents is constructed to dispense various combinations of stamps of various denominations from modules of the machine that include for each module a magazine containing a roll of a strip of stamps. Each module is operated to feed, for one cycle of operation, a length of a strip through an associated opening in the front panel of the machine. The length of the strip fed through the opening is dependent upon the number of stamps to be dispensed from the module. The number of stamps, as a strip, that pass through the opening, is dependent upon the coins or coin, respectively, introduced in the slot in the front panel and, in the case of the machine of U.S. Pat. No. 3,548,991, is dependent upon the button that is pressed to select a particular combination of stamps. When sufficient change has been fed through the slot of the machine of U.S. Pat. No. 3,548,991 and a button corresponding to the change is pressed, the cycle of operation of each module required for the dispensing of the particular combination of stamps is initiated.

For each module having its operation initiated, its motor will turn a feed wheel or a drive roller for a predetermined number of steps of partial rotation to feed through the associated opening a length of the strip that is subsequently cut or manually torn from the balance of the strip that remains inside the machine. At the completion of the operation of a module of the machine, the module of each patent is constructed to prevent the strip from being manually pulled through the opening to obtain more stamps than was fed through the opening in the machine during the programmed operation of the module.

The module used in the machine of U.s. Pat. No. 3,548,991 is an improvement over the single stamp dispensing module used in the machine of U.S. Pat. No. 3,538,801. In that earlier module a pulse, provided by pressing a select button, to a solenoid initiates the operation of the module to present externally of the module a number of connected stamps that this module can feed during one cycle of its operation. This operation of the solenoid by the initiating pulse raises a pawl from a counting wheel. The raised pawl closes a switch that energizes a driving motor that then turns a drive roller. At the time that the motor is energized, the closed switch energizes a solenoid to move a cutter from the opening through which the strip of stamps passes. The counting wheel is rotated by a moving strip over which it passes before passing between the drive roller and a pinch roller. The counting wheel has rows of projections that are spaced so that they mate with perforations between adjacent stamps of the strip of stamps and thereby the counting roller is turned to count, as the strip is pulled between the drive roller and the pinch roller. The counting roller has also a plurality of notches about its periphery and the pawl of a pawl assembly, when raised, is moved out of one of these notches. The construction of the pawl assembly is such that the pawl moves into the next notch during the turning of the counting wheel. When this happens, the switch opens whereby the driving motor is de-energized and the solenoid for the cutter is denergized. The cutter operates to cut the strip of stamps at the opening of the dispensing module. This cut is at a row of perforations of the strip. The opening of the switch stops the drive of the strip of stamps because it stops the rotation of the driving roller. The number of stamps that is dispensed through the opening is determined by the equal spacing between the notches of the counting wheel. To change the number of stamps dispensed by the module for a cycle of operation, it is necessary to replace the counting roller with a counting roller having different equally spaced notches. With this construction of the module of a stamp vending machine, it is not possible for a particular stamp denomination to use the machine to dispense different numbers of stamps merely by pressing different buttons.

U.S. Pat. No. 3,548,991 discloses a dispensing module that is basically the same as that disclosed in U.S. Pat. No. 3,538,801. It has a latch arm, that is raised by the operation of a latch solenoid by a pulse, that is provided by operating a select switch. The latch arm is raised, by the operations of the latch solenoid, from the one of the equally spaced notches in the counting wheel, that has the equally spaced rows of projections. This movement of the latch arm closes a latch arm switch to start the operation of the driving motor. The counting wheel is driven by the motor. The motor is also coupled to a countdown gear. Selector solenoids are mounted on the frame of the module and engage latch triggers that control a trip cone for de-energizing a countdown switch. The selector solenoids are counting solenoids and they select the number of stamps which will be dispensed for a particular operation of the module. The operation to dispense a number of stamps is determined by which of the counting solenoids is energized. The latch solenoid maintains the latch arm out of contact with the counting roller until the countdown gear has been turned by the motor to the position that the energized counting solenoid is effective to de-energize the latch solenoid that raised the latch arm. The arm lowers to engage a notch in the counting roller and the latch switch is de-energized so that the motor stops. Then the counting wheel is locked by the lowered arm so that the strip of nondispensed stamps cannot be pulled out of the module.

The stamp vending machine of U.S. Pat. No. 3,548,991 is constructed using standardized modules and by wiring a control system so that one or more jumper plugs may be changed to vary the operation of the machine. To change the operation of the machine it is necessary to change one or more jumper plugs and/or terminal blocks to those that are specially made by the manufacturer. This can be done in the field by a serviceman. It is stated also that the leads between two terminal boards are quickly changed in the field by the serviceman.

The control circuit of U.S. Pat. No. 3,655,109 utilizes electrical patch boards for determining, based on signals from closed relay contacts, the number of stamps to be dispensed in a dispensing cycle for each of the stamp dispensing modules. To change the number of stamps of one denomination dispensed in the operation of the machine it is necessary to replace the patch board with a different patch board. The patent discloses that this function of determining the number of stamps to be dispensed from a module can be accomplished by the use of a manually-operated keyboard, a tape switch, a rotary dial switch or other manual or automatic programming means. The patent also states that the relays and other electromechanical devices disclosed in the specific construction of the control circuit can be replaced by solid state or other electronic elements. Obviously, such substitution would use solid state elements that provide the same function as the individual relays and other electromechanical devices that are used in the control circuit.

SUMMARY OF THE INVENTION

The stamp vending machine of the present invention is useful for dispensing stamps, labels, or other forms of a continuous roll of periodically perforated paper or other material in the predetermined increments of the perforated segments. For simplified description, the machine of the invention is described below in its use for dispensing stamps from a roll of a strip of stamps.

The machine includes acceptor/rejector means that accepts coins or paper money to provide signals at one or more of its outputs. The outputs that are provided with signals depends upon the value of the coin or total value of coins or upon the use of paper money added to the acceptor/rejector means. The machine further includes a set of manually-operated switches, a main control logic, and a number of stamp dispensing mechanisms as modules. Each module includes a module control logic including a binary counter, motor means connected to the module control logic, a strip-feeding wheel assembly having a feed wheel and means connected to the feed wheel and to the motor means to impart stepwise movement of the feed wheel when the motor means is operated, count switch means operated at the completion of each step movement of the feed wheel, means to support a roll of a strip of stamps, and a guide having a slotted opening through which the strip passes as the strip is moved beyond the wheel by the stepwise movement of the feed wheel during the operation of the motor means.

The main control logic has sets of outputs and a set of additional outputs. The module control logic of each module has a set of inputs and an additional input along with an output that is connected to the motor means of that module. Each input of the set of inputs of the module control logic of each module is connected to a different output of one set of outputs of the main control logic. The additional input of the module control logic of each module is connected to a different output of the set of additional outputs of the main control logic.

The main control logic has a construction to provide, by one or more of a number of programming networks of that logic, binary information to one or more sets of outputs, of the sets of outputs, with each set being connected to a set of inputs of the module control logic of a different module, i.e., different stamp dispensing mechanism. The main conrol logic has a number of inputs with each input being connected to a contact of a different switch of the set of manually-operated switches that are connected to outputs of the acceptor/rejector means. Two or more switches may be connected to the same output of the acceptor/rejector means.

The main control logic is constructed so that one or more of the outputs of its set of additional outputs is provided with a signal and thereby each of these outputs provides a signal to the additional input of the module control logic to which that output is connected. The main control logic is constructed so that this signal is provided only if there is a signal provided by the operation of one of the manually-operated switches to that programming network, of the programming networks, that has its set of lines connected to that set of outputs of the main control logic that are connected to the set of inputs of that module control logic.

The networks of the main control logic are provided by sets of lines connected to the sets of outputs of the main control logic, as described above, and an additional set of lines connected to a number of inputs of the main control logic. Each line of each set of the sets of lines is connected to a number of spaced terminals. The additional set of lines are connected to different inputs of the main control logic. Each of these lines of the additional set of lines is connected to spaced sets of a number of spaced terminals. Each spaced terminal of the number of spaced terminals of each line of each set of the sets of lines is located relative to one of the terminals of one of the sets of terminals connected to a different line of the lines of the additional set of lines to provide pairs of terminals so that for each line of the sets of lines the terminals connected to that line can be selectively connected to terminals connected to the lines of the additional set of lines.

The programming of the operation of one or more modules and the number of stamps to be dispensed is by the connection of specific pairs of terminals. For a specific operation of the machine, the main control module includes a number of diodes connecting specific pairs of these pairs of terminals.

When one of the manually-operated switches is closed, as a selection of a specific number of stamps of one denomination or a combination of stamps of different denominations, binary information will be provided as signals to one or more of the sets of outputs of the main control logic. Each set of outputs provided with this binary information will be a result of the connection of one or more diodes connecting specific pairs of the pairs of terminals connected to that set of outputs. The binary information provided to one set of outputs can be the same as or different than the binary information provided at one or more other sets of outputs.

Two or more sets of outputs, that are connected to module control logics of modules having stamps of the same denomination, can be provided with the same or different binary information. In the absence of additional construction, that is present in the prefered embodiment, these modules will dispense stamps of that denomination in a total indicated on the panel of the machine and effectuated by the operator pressing that selected manually-operated switch.

In the preferred construction of the vending machine of the invention the main control logic is constructed so that only one of the modules of two or more having the same denomination of stamps will operate to dispense the selected number of stamps of that denomination and the other one or more modules will serve as a backup or sequential backups for the module that is operated as a result of the closing of the manuallly-operated switch that has been selected. In that case the backup module for another module is rendered inoperative by the circuitry of the main control logic until the module for which it is a backup becomes "empty." Thus the preferred construction of the main control logic includes means to render inoperative a backup module until the module, for which it is a backup, provides a signal. In this embodiment each module includes a switch, responsive to the absence of sufficient nondispensed stamps, to provide this signal.

In the preferred construction each of these modules is provided with this stamp-sensing switch and the signal that it provides, when the condition of no stamps is sensed, is utilized in the construction of the main control logic to prevent the transfer of a signal to that additional output, of the set of additional outputs of the main control logic, that is connected to the module that has that switch. For this construction the main control logic has a number of additional inputs with each additional input being connected to a stamp-sensing switch of a particular module. Also, the construction of the circuitry of the main control logic provides means to prevent the transfer of a signal to that additional output of the set of outputs that is connected to the module having the stamp-sensing switch, if it is closed, so that the signal will not be provided to that module even though the closing of the appropriate manually-operated switch resulted in the transfer of binary information by one of the set of outputs to the set of inputs of the module control logic of that module.

In this construction of the main control logic, that prevents the operation of a module that is "empty" if there is no backup module or if it is the backup module, the means, that is in the construction of the main control logic to prevent the transfer of the signal to the logic control module of that module, is connected to switch means as a part of the main control logic, to provide a flow of current through a light to indicate that the operator of the machine should make another selection.

The main control logic further includes in its construction means to operate an additional switch means of the main control logic, when the signal or signals are provided to one or more outputs of the set of additional outputs for operation of one or more modules. This additional switch means has an output connected to the acceptor/rejector means so that the latter will operate to complete the transaction and thereby store the coins received that total at least the monetary value of the selection made and return the balance, if any, as a coin or coins to the operator.

In one preferred embodiment, that is described below, the vending machine of the invention uses a particular type of coin changer as the acceptor/rejector means. That coin changer has a number of outputs that provide at one or more of the outputs signals resulting from the totalling of the coins deposited. Each of these outputs having the signal will provide alternating current when the circuit is closed. Each of these outputs is connected to one or more of the manually-operated switches mentioned above. Each of these switches has its other contact connected to a different input of the set of inputs of the main control logic. Each of these inputs is connected to a different one of a number of optically coupled isolator means that are provided in this embodiment as a part of the construction of the main control logic. As a result, alternating current is provided to one of these optically coupled isolator means if the associated manually-operated switch is closed and if the output of the coin changer to which it is connected has been provided with AC voltage by the total of coins added to the coin changer.

Each of the optically coupled isolator means has a transistor that is conductive when there is a flow of alternating current through the optically coupled isolator means. Each transistor has one of its collector and emitter, preferably collector, connected to one of the lines of the additional set of lines that is connected to a number of spaced terminals. In this case one or more of these pairs of terminals provided in the construction of the main control logic, as described above, is connected by a diode so that current will flow to the emitter of the diode of the associated optically coupled isolator means when alternating current flows through that isolator means. In this construction the main control logic includes circuitry to provide, after a delay, the signal, as a pulse, that must be received by other components of the circuitry to provide from one of these components a signal, as a pulse, to one of the additional outputs of the set of additional outputs of the main control logic for the initiation of the operation of the associated module. The construction that provides this delay is incorporated to insure that a complete half wave of the alternating current is provided to the operation of the optically coupled isolator before the circuitry functions. This is to provide an output that results in the pulse mentioned above. If there was not a delay provided by the circuitry, the first pulse provided by the emitter of the transistor of the optically coupled isolator means, that is provided with the alternating current, may not be a signal with sufficient duration. In that event, the module would not operate. The money would be returned.

In a specific aspect of the invention, illustrated by the preferred embodiment, the main logic control further includes in its construction means to lock out the operation of a second optically coupled isolator means when a first isolator means, that is connected by a manually-operated switch to the same output of the coin changer, is provided with alternating current to provide the operation of the transistor of the first isolator means. In other words, the lock-out means provides a signal to the transistor of the second isolator means to prevent the operation of two optically coupled isolator means that are connected by separate manually-operated switches to the same output of the coin changer. Thereby the change in voltage level occurs only in one of the lines of sets of lines connected to the number of optically coupled isolators even though those two manually-operated switches are closed, with the first shortly before the second, after adding only one quantity of coins. The lock-out means can prevent the current flow in the transistor of the first isolator means if the flow in the transistor of the second isolator means is already provided by a change in the sequence of closing the switches.

DESCRIPTION OF THE DRAWINGS

The drawings disclose a preferred embodiment of the stamp vending machine of the present invention.

FIG. 3 is a fragmentary elevation of one of the modules as viewed from the side that shows the means for transferring one cycle of rotation of a driver arm to a single step of turning of the feed wheel of the stamp-dispensing mechanism and showing further the mounted printed circuit board of the module control logic of that module.

FIG. 4 is a fragmentary elevation of the module of FIG. 3 as viewed from the other side of the module.

FIG. 4A is a fragmentary view of a stamp guidance roller and the arm of the stamp-sensing switch of the module taken along line 4A—4A of FIG. 4.

DETAILED DESCRIPTION

Figure 1:
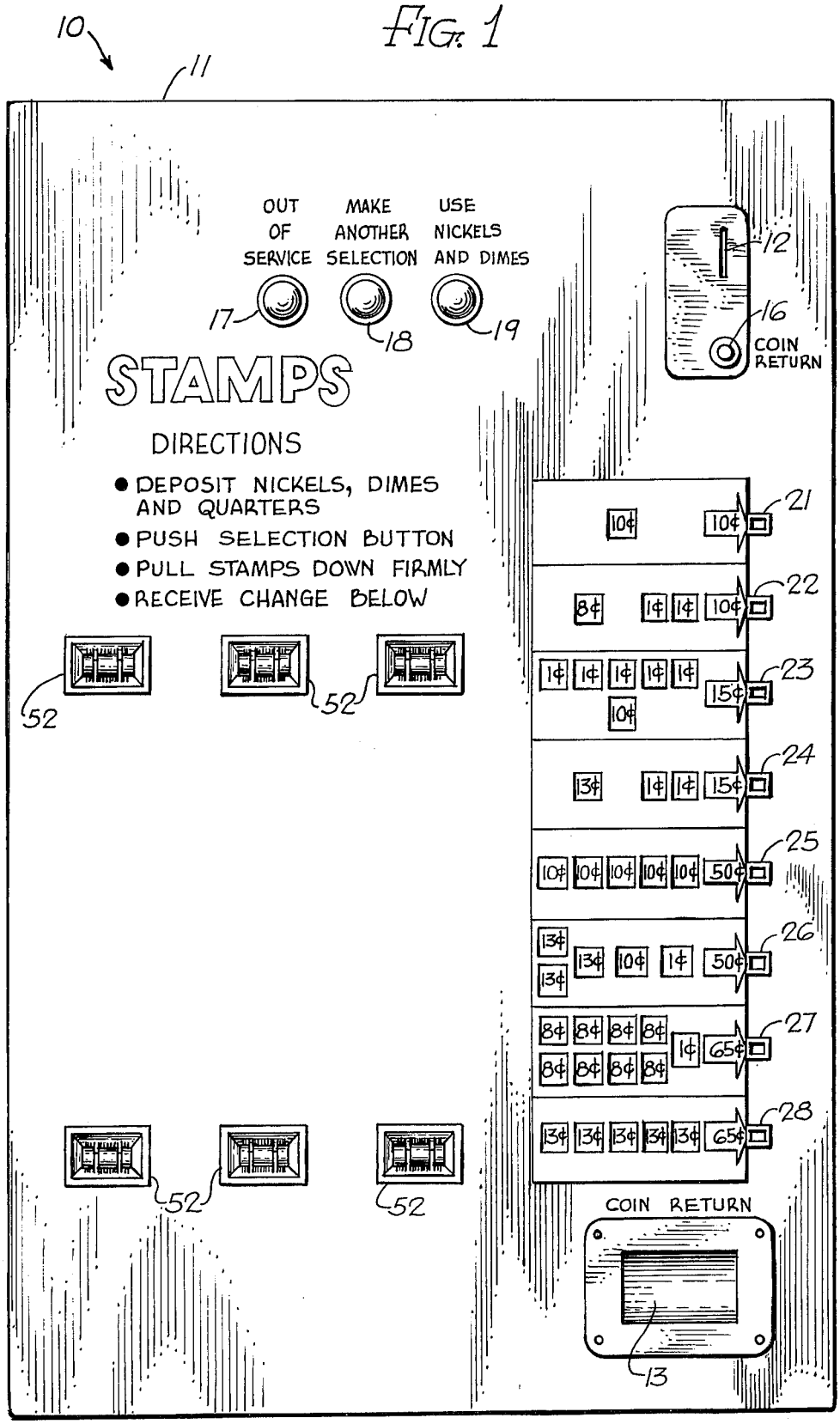
FIG. 1 is a front elevation of the stamp vending machine showing, on the front panel of the housing, various indicia that provide directions for the use of the machine by a customer for stamps, indicia of the cost and the denomination of and number of stamps that will be dispensed for each of the possible selections of stamp dispensing as a result of pushing buttons, and indicia explaining the significance of each light when lit.

As seen in FIG. 1, the stamp vending machine of the invention has a housing generally indicated at 10 with a front panel 11. A coil slot 12 is mounted at the upper right-hand portion of panel 11 while a swinging door 13 is at the bottom right-hand portion of panel 11. The door 13 is pivoted at its top margin. A coin changer 14 (FIG. 2) is mounted behind panel 11. The coin slot 12 communicates with a downwardly and rearwardly extending coin chute 14' having a substantially rectangular cross section. The lower end of coin chute 14' overlies a coin-receiving top opening of coin changer 14. The coin changer 14 includes in its construction a coin collection receptacle 15 and a coin return receptacle 15' (FIG. 2) that includes door 13. Any coins transferred from coin changer 14 to receptacle 15' are removed by opening door 13. The panel 11 also has mounted on it a pushbutton 16 of a switch assembly having a pushbutton switch that is closed when pushbutton 16 is pressed to operate coin changer 14 to release the coin or coins introduced through slot 12 by dropping the coin or coins to receptacle 15' if the operator of the stamp vending machine decides not to obtain stamps. This he can do provided he has not pressed one of the pushbuttons mentioned below. The pushbutton 16 is identified by indicia on panel 11.

Also mounted on panel 11 are lights 17, 18 and 19. As shown by some of the indicia on panel 11, light 17 is on when the machine is out of service, light 18 is on when the customer is requested to make another selection, and light 19 is on when the customer is requested to redeposit money limited to the use of nickels and dimes.

The panel has six rectangular openings with three each at two elevations. Into these openings partially extend the enclosures of six modules, i.e., stamp-dispensing mechanisms, so that stamps from one or more of the modulates are dispensed forwardly through these openings.

Also printed on the panel are eight rectangles alongside a vertical array of pushbuttons of pushbutton switches 21 through 28. Within the eight rectangles there are printed the cost, and the denomination and number of stamps that will be dispensed by the pressing of the associated pushbuttton, if sufficient money has been added. The directions of use are printed on another part of panel 11.

Figure 2:
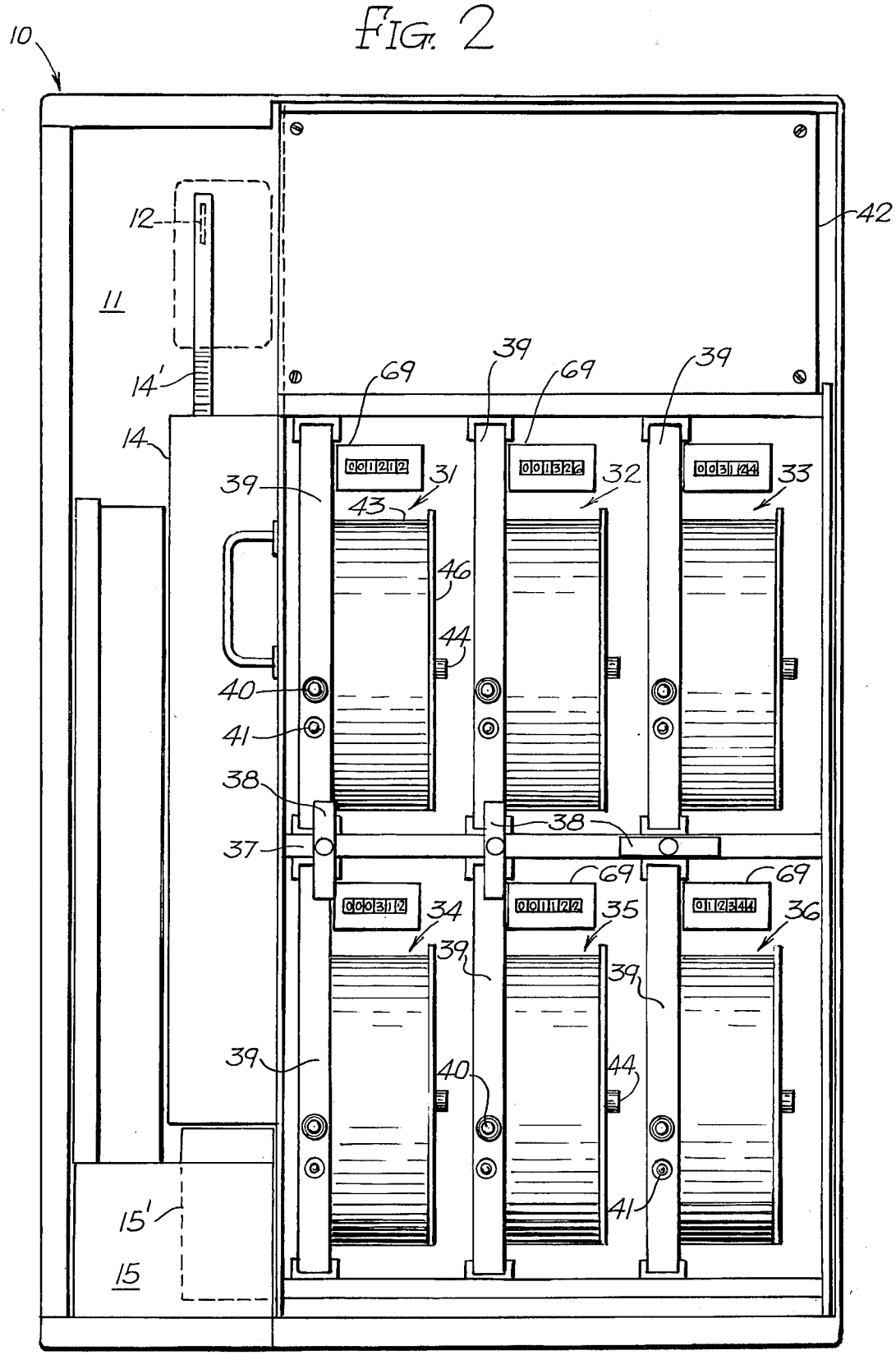
FIG. 2 is a rear elevation of the machine with the door removed to show the location of six modules, i.e., stamp dispensing mechanisms of the machine and other components of the machine.
Figure 7:
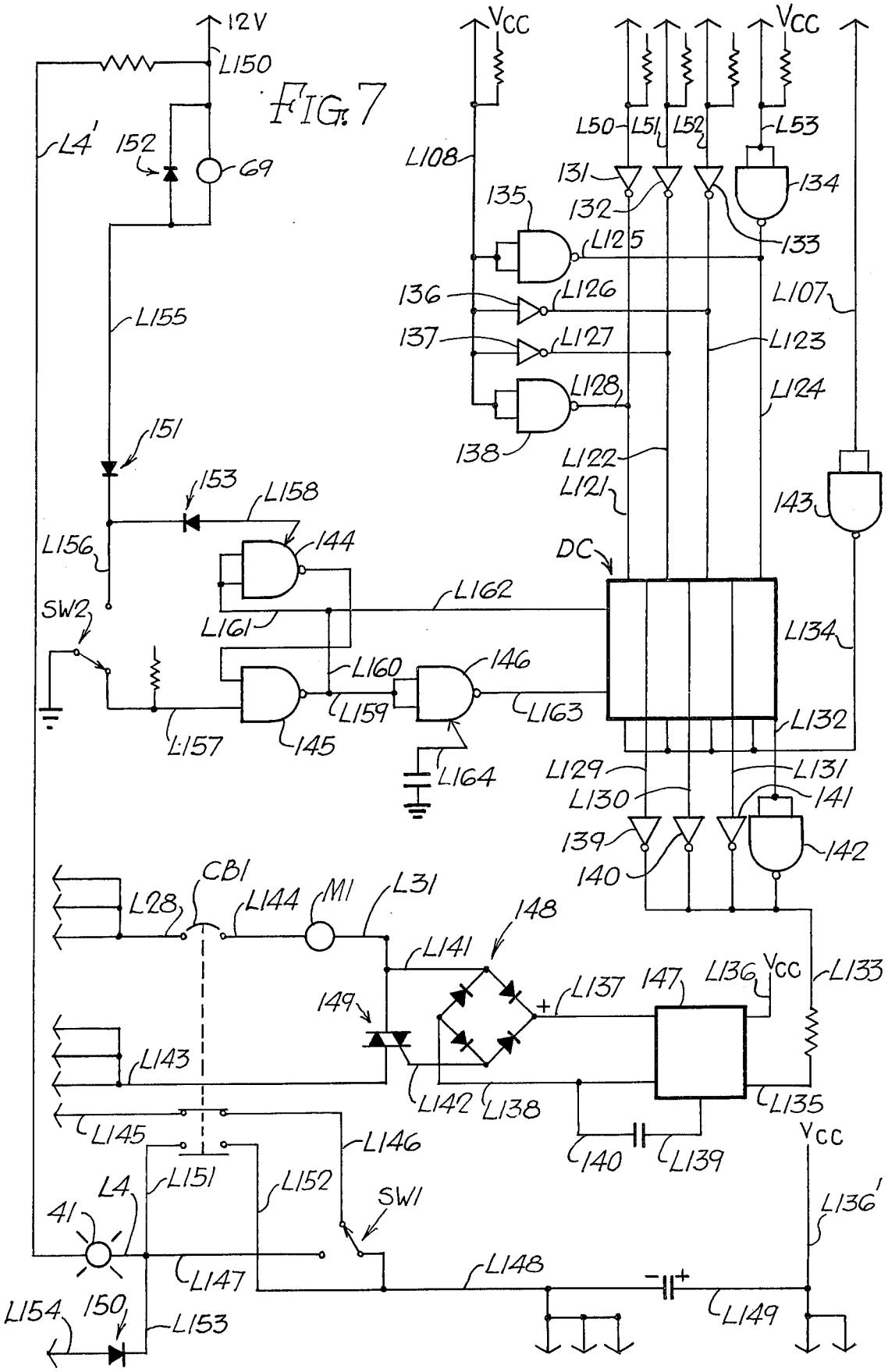
FIG. 7 is a schematic drawing of one of the module control logics along with other circuitry connected to it to provide for the operation of the motor means of that module and to provide an indication, by the turning on of an LED, when insufficient stamps remain in the module for a subsequent operation of the module.

As seen in FIG. 2, the housing is constructed in a manner to provide two sets of three spaced horizontal U-shaped channel guide supports (not numbered) at two elevations and spaced above each set are mounted a set of three inverted horizontal channel guides (not numbered), that are used to support six modules, generally indicated at 31 through 36. The channel guide supports of the upper set are supported by a horizontal member 37 that also supports the lower set of inverted horizontal channels. Mounted on horizontal member 37 at suitably spaced locations are retainer bars 38 that can be locked by a screw (not numbered) in a threaded hole in member 37 to abut, for each bar, a top and bottom module to maintain them in a locked position. When a screw is loosened and retainer bar 38 is turned from the vertical to the horizontal position, a top module and a bottom module can be moved into or out of position. Each of modules 31 through 36 includes a vertical support plate 39 having at one vertical edge a flange (not numbered) through which extends a button 40 of a circuit breaker CB (FIG. 7) described later. Also mounted on this flange is a LED 41, that is shown in FIG. 7 and described later.

The main control module of the stamp dispensing machine includes a printed circuit board 42, that as seen in FIG. 2, is mounted above the set of six modules. The board 42 has a large number of printed conducting lines, some of which extend to the margins to provide outputs and inputs to which connectors are joined. Various components of the main control logic are mounted on board 42 and these are connected to these printed conducting lines. These components and the printed conducting lines are shown schematically, along with other electrical components of the machine, on FIGS. 6 and 6A.

The stamp vending machine includes any of the standard off-the-shelf coin acceptor/rejectors or paper currency acceptor/rejectors that have counting, validation controlled escrow, and change-making capability. One commercially available coin changer is the F150-9400 coin changer sold by Coin Acceptors, Inc., St. Louis, MI. It will receive nickels, dimes and quarters and totalize the value of the coins. This coin changer is hereinafter identified as coin changer 14. It has an electronics logic system that can totalize the monetary value from 5¢ through $1.50 for any of four different price totals. It has the escrow feature that allows the customer to get back the amount deposited any time before a delivery is made. The change that is paid out is from self-loading nickel and dime coin tubes. This coin changer is constucted to transfer the coin or coins held in escrow to the coin return receptacle if the customer has added coins that require a return of change and the nickel coin tubes are empty. If the dime coin tube is empty, the coin changer pays out the change in nickels, if present in the nickel coin tube.

Figure 5:
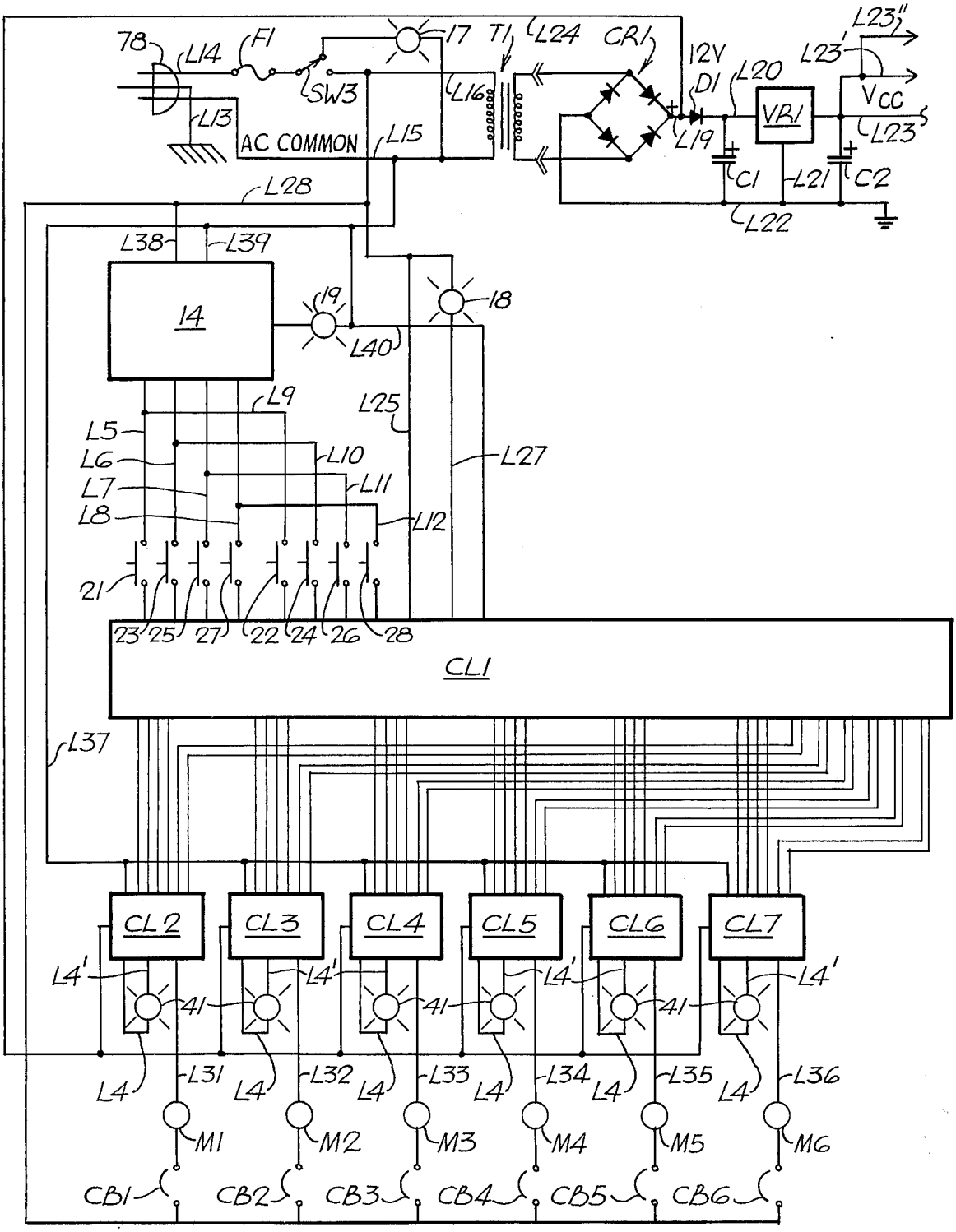
FIG. 5 is a block diagram showing the main control logic, the module control logics and other components of the electric circuitry of the machine of the invention.
Figure 6:
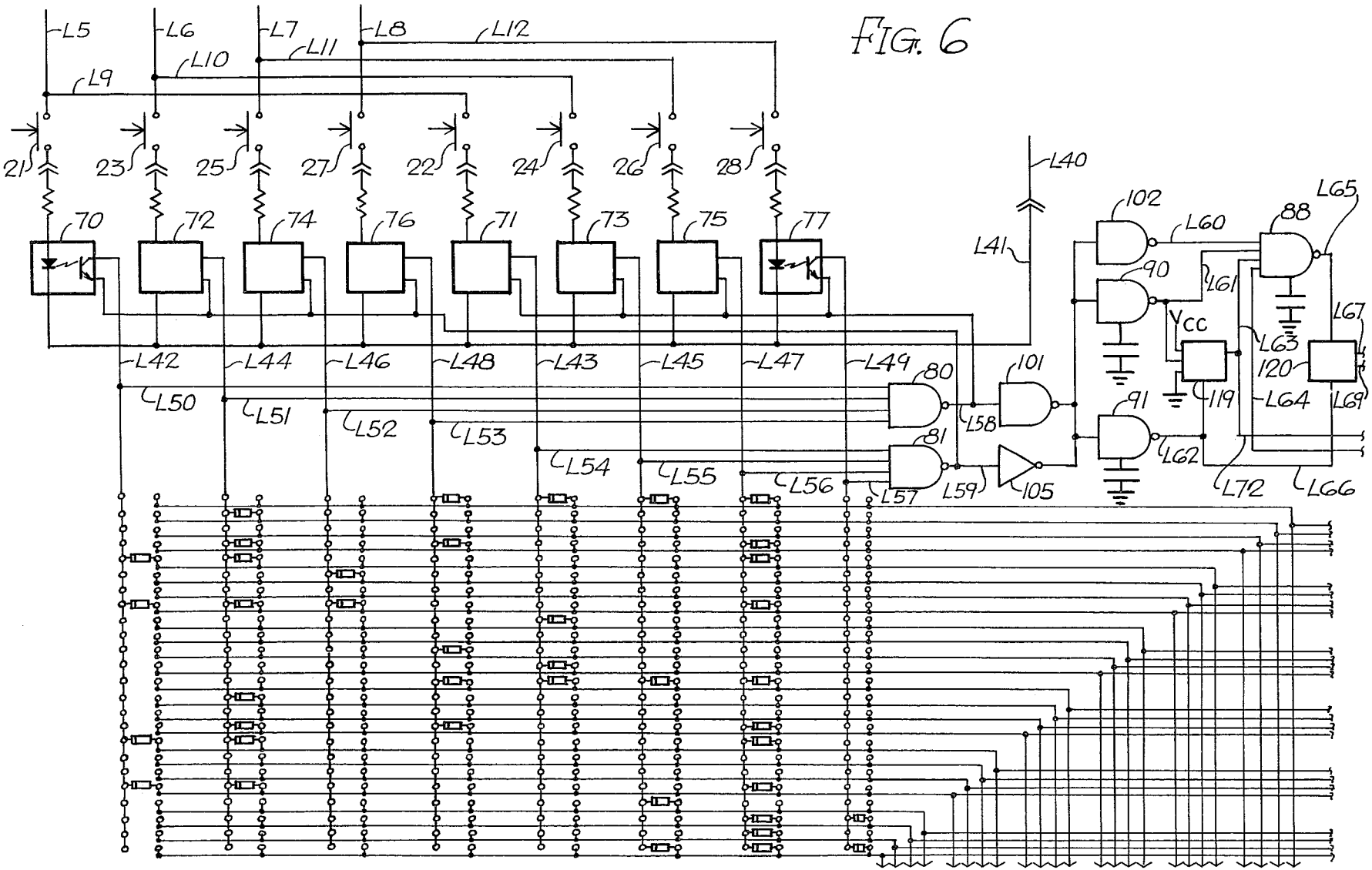
FIGS. 6 and 6A taken together show schematically the main control logic that is provided by components mounted on the main printed circuit board having printed conducting lines and show other circuitry including the pushbutton switches mounted on the front panel, as seen in FIG. 1, the lines connecting these pushbutton switches to outputs of the coin changer, and other circuitry to turn on two of the lights mounted on the front panel when certain conditions are met.

This coin changer has four price switch modules. Each module has five rocker switches. One or more of the switches of a module are selectively rocked to the on position. The choice is dependent upon the vend price and entered into the electronic logic system. The five switches have values of 5, 10, 20, 40 and 80 cents and thus are equivalent to binary numbers of 1 through 16. The four price switch modules have some of their rocker switches set to the on position, for the purpose of this illustration, to corresponding to vend prices of 10, 15, 50 and 65 cents. The logic system of this coin changer has four outputs that provides AC voltage to one or more of lines L5 through L8 (FIGS. 5 and 6). For example, if the customer adds coins totalling at least 50¢ but not totalling 65¢, this coin changer will provide AC voltage to lines L5 through L7 but not to line 8.

The F150-9400 coin changer also has its logic system constructed to transfer the coins that are added to the return receptacle in the event current starts to flow simultaneously to two or more of its outputs. In this event the operation of a transaction is not initiated by the coin changer. Furthermore, the construction is such that if current starts to flow to a second output while current is flowing to one output, the voltage at the second output ceases so that only one transaction is effectuated. Furthermore, if a transaction is chosen that has a required value exceeding the value of the coins added, the coins are transferred to the return receptacle.

The modules 31 through 36 have the same construction. FIGS. 3 and 4 show module 31 that includes a number of components mounted on support plate 39 that is in vertical position when installed in housing 10. Some of these components are on one side and some are on the other side of support plate 39. Certain components, namely shafts, extend through support plate 39. For this description of module 31, FIG. 4 is described as a front elevtion, i.e., as viewed from left in FIG. 2. The module 31 has its mechanical components constructed and mounted in the manner shown and described in said copending patent application. This is the preferred construction of the module. Accordingly, some of the details are not expressly stated in the following description.

As seen in FIG. 4, module 31 includes a cylindrical wall 43 extending from and normal to support plate 39. Concentric with wall 43 is a boss 45 in which is fixed an internally threaded tube (not numbered) in which is received a screw 44 that retains a cover disc 46 against the outer edge of wall 43. A small diameter short cylinder 47 of a roll of a strip of stamps 48 is mounted on boss 45 for free rotation. The free end of roll 48 extends through an opening 49 of wall 43, and is trained over a cylindrical guidance roller 50, under a guide roller and over and beyond a feed wheel. The strip of stamps extends to a slotted opening of an enclosure 52 of module 31. During the dispensing cycle, dispensed stamps as a part of strip 48 pass beyond the enclosure 52 so that they are external of module 31. In that case the dispensed stamp or dispensed stamps extend forwardly of panel 11 of housing 10 when module 31 is located in housing 10, as shown in FIG. 1 and 2. The guide roller and the feed wheel are shown in said copending patent application.

The guidance roller 50 has cylindrical flanges at its ends to keep the strip in a direct line of travel toward the guide roller and the feed wheel. The guidance roller 50 has an intermediate annular recess. A stamp-sensing switch SW1 is mounted on this side of vertical support plate 39 and has a button 53 that moves the moving contact of switch SW1 when button 53 is moved. The switch SW1 has an arm 54 that is biased on button 53 toward guidance roller 50 at the location of its annular recess. When a stamp of the strip is on guidance roller 50 at this location, arm 54 is moved to depress button 53 so that the moving contact (FIG. 7) of switch SW1 engages one of the fixed contacts of switch SW1 to provide a low-level signal that indicates that there are sufficient stamps for at least the next cycle of operation of the stamp dispensing machine. When the last stamp passes this point during a dispensing operation, arm 54 moves into the annular recess of guidance roller 50. When button 53 is not depressed by arm 54 the moving contact of stamp-sensing switch SW1 (FIG. 3) moves from the first fixed contact to change the signal to a high level signal and engages another fixed contact to provide current flow to turn on LED 41 to indicate that module 31 is essentially "empty" of stamps.

The feed wheel is supported by support plate 39 for rotation about a horizontal axis. An arcuate guide is pivotally mounted about a horizontal axis of the guide roller. The arcuate guide has a concave cylindrical surface that, when held in position, faces downwardly toward the top portion of the feed wheel and is coaxial with the feed wheel. This concave surface has a set of grooves that are coaxial with the concave surface so that rows of projections on the feed roll can pass through these grooves with the concave surface closely spaced from the cylindrical surface of the feed wheel to insure that the strip 48 of stamps is maintained with its rows of perforations on the projections of the feed wheel during the travel of strip 48 over and around the feed wheel and is maintained in this engagement after and during the time that dispensed stamps are pulled from the nondispensed portion of strip 48.

A motor and a gear train connected to the motor are mounted on this (front) side of vertical support plate 39 as shown in said copending patent application. A drive shaft 60 of the gear train extends through support plates 39. The feed wheel is fixedly mounted on another shaft that extends through support plate 39 from the other (rear) side of plate 39.

As seen in FIG. 3, a tapered arm 61 is fixedly mounted on shaft 60. A Geneva star wheel assembly includes in an integral construction a gear 62 and a star wheel 63. The tapered arm 61 is a part of a Geneva drive assembly that includes a driver pin 64 mounted on arm 61 and extending normal to arm 61 toward support plate 39. During one rotation of arm 60, pin 64 enters into one of the equally spaced slots 65 of star wheel 63 and then out of it to step star wheel 63 one portion of one revolution of that wheel. That steps gear 62 to step a gear 66 meshing with it. The gear 66 is fixedly mounted on that shaft on which the feed wheel is fixedly mounted on the other side of support plate 39.

The construction of arm 61 to provide an automatic locking of the feed wheel by the locking of star wheel 63 utilizing one of the concave intermediate peripheral surface portions of star wheel 63, that are between adjacent slots 65, is fully described and shown in said copending patent application. The entire cylindrical peripheral surface, including the concave portions, of star wheel 63 is utilized in the preferred embodiment, that is shown, to operate a switch SW2, that has an arm 67 extending to this peripheral surface of star wheel 63. The switch SW2 also has a button 67' that biases arm 67 toward and into contact with the peripheral surface of star wheel 63. When drive arm 61 turns sufficiently to move driver pin 64 into one of slots 65, the continued turning of drive arm 61 steps star wheel 63 so that the concave portion of star wheel 63 moves away from arm 67. Then arm 67 comes into engagement with the peripheral cylindrical portion of wheel 63. This results in the depressing of button 67'. The arm 67 is sufficiently long to span slot 65 during this stepping of wheel 63. By the balance of the step movement of wheel 63, arm 67 is moved into the next concave portion of the peripheral cylindrical surface of wheel 63 by button 67'. When drive pin 64 of drive arm 61 leaves slot 65, arm 67 is entirely within that cavity of wheel 63 and button 67' is fully released. When button 67' is depressed, the moving contact of switch SW2 has been moved from engagement with a first fixed contact to a second fixed contact, and when button 67' is released the moving contact returns to engage the first fixed contact. This movement of the moving contact from the first fixed contact to the second fixed contact and then to return to the first fixed contact provides a count pulse to a decade counter DC (FIG. 7) that is a part of module control logic CL2.

As seen also in FIG. 3, there is a printed circuit board 68 mounted on this side of support plate 39. Various printed conducting lines are on board 68. They and various components joined to these conducting lines constitute the module control logic CL2, that is shown in FIG. 7 along with other components of module 31 that provide for the initiation and stopping of a motor M1 (that is the motor for module 31), turning on LED 41, and operating a counter 69 that is also mounted on vertical support plate 39. Of course, there are various lines extending between the module control logic and counter 69, LED 41, and motor M1 and others extending between control module logic CL2 and main control logic CL1.

In FIG. 5, logic control module CL2 for module 31 is shown along with logic control modules CL3 through CL7 for modules 32 through 36, respectively. It is seen in FIG. 5 that there are separate sets of four lines (not numbered). Each set of four lines extends between main control logic CL1 and a different one of module control logics CL2 through CL7. There also are separate pairs of lines (not numbered) extending from main control logic CL1 to different module control logics CL2 through CL7. Each of modules 31 through 36 is connected to a line L3. Each LED 41 is connected to two terminals of the associated module control logic by lines L4 and L4'.

The unnumbered set of four lines connecting main control logic CL1 and module control logic CL2 connect four outputs of the former to four inputs of the latter to provide binary information as signals to that module control logic, if module 31 is to be operated for a cycle of operation of the stamp dispensing machine. The sets of four lines to the other five modules provide binary information to those modules whenever selected for a dispensing operation. The module or modules of the six modules, that are to be operated for dispensing stamps during one cycle of operation as selected by the customer by pressing one of the buttons of pushbutton switches 21 through 28 after introducing sufficient coins to the machine, is determined by the main control logic that provides binary information as signals to one or more of the sets of four lines.

As seen in FIG. 5, coin changer 14 has four outputs connected to four wires shown as lines L5 through L8. Connected to lines L5 through L8 are four lines L9 through L12. Each of lines L5 through L12 is connected only to one of push button switches 21, 23, 25, 27, 22, 24, 26 and 28, respectively. Each connection is to one contact of the switch. The other contact of these pushbutton switches is connected by wires, shown as lines (not numbered), and a connector that connects these lines to different wires, shown as lines (not numbered), on main printed circuit board 42. Each of those lines on board 42 is connected through a resistor (not numbered) to an input terminal of one of optically coupled isolators 70 through 77, respectively. This connection is to the anode of the light-emitting diode of the isolator. These optically coupled isolators are illustratively Fairchild's FCD820 optically coupled isolator.

One line of each pair of lines connecting outputs of the main control logic CL1 to module control logics CL2 through CL7 is used to carry a signal, as a pulse, to start the operation of the module control logic to which it is connected to an input. That start pulse is provided only to the module or modules to dispense stamps, as selected by the customer pressing one of the buttons of the pushbutton switches 21 through 28. The other wire of each pair between the main control logic CL1 and the module control logics CL2 through CL7 provides a reset signal to each module whenever power is restored after electric power to the machine has ceased. Thus each of these second wires of the pairs is connected by a connector to the same conducting line on circuit board 42 by a number of connecting short lines having their other ends as outputs to which the connector is electrically coupled.

As shown schematically in FIG. 5, the three wires of a single-phase two-wire AC circuit with ground wire are connected to a plug 78. The ground line L13 of plug 78 connects to the chassis, i.e., housing 10, of the machine to ground it. The plug 78 is connected also to a line L14 and a line L15 that thereby become the AC hot and AC common lines. The other end of line L14 is connected to one contact of a fuse F1 that has its other contact coupled to a moving contact of a double-throw switch SW3. The moving contact is at the position shown in FIG. 5 in which it engages a fixed contact that is connected to one contact of light 17 that has its other contact connected to line L15 so that light 17 is on whenever switch SW3 completes a circuit between fuse F1 and light 17. Ordinarily the moving contact of switch SW3 engages the other fixed contact that is connected to a line L16 to connect line L16 to fuse F1. The lines L15 and L16 are connected to the primary coil to a transformer generally indicated at T1. The secondary coil of the transformer, to provide 12 volts, is connected by lines L17 and L18 to two terminals of a full-wave bridge rectifier CR1. One of the other terminals is connected to a line L19 that is connected to the anode of a diode D1, (IN1002), that has its cathode connected by a line L20 to an input terminal of a voltage regulator VR1. The ground terminal of voltage regulator VR1 is connected by a line L21 to a line L22 that is connected to ground and to the fourth terminal of bridge rectifier CR1. The lines L20 and L22 are connected to a capacitor C1. The output terminal of voltage regulator VR1 provides voltage $V_{CC}$ to a line L23. A line L23′ is connected to line L23. A line L23″ is connected to line L23′. These two lines are connected to six pairs of wires to provide $V_{CC}$ voltage, i.e., collector supply voltage, to modules 31 through 36. The line L23 is a printed conducting line on circuit board 68, as are lines L17 through L25. Conducting lines (not numbered) connect lines L22 and L23 to a capacitor C2. Some of the lines mentioned above are actually printed conducting lines on circuit board 68. These lines are 12-volt lines. Other lines mentioned above are actually wires because they are provided with higher voltage, namely, 120 volts.

A line L24 is connected to printed conducting line L19. The line L24 is shown as connected by other lines (not numbered) to one terminal each of module control logics CL2 through CL7. Two terminals of each module control logic are connected to the six LEDs 41. Each module has a decimal counter and that decimal counter for module 31 is counter 69 (FIG. 7), that is connected to one fixed contact of count switch SW2 (FIG. 7) and to a terminal of module control logic CL2. For simplification, line L24 and lines connecting it to each module control logic are shown as one line with connecting lines. However, part of line L24 is a printed conducting line on main control logic CL1 and another part is set of wires with each wire connecting that terminal of the main control logic with a terminal of a different module control logic.

A line L25 connects AC hot line L16 to a terminal of main control logic CL1. A line L26 is connected to line L25 and to light 18 that is connected by a line L27 to a terminal of main control logic CL1. A line L28 is connected to line L26. The line L28 is connected to one contact each of circuit breakers CB1 through CB6. These circuit breakers have their other contact connected to motors M1 through M6, respectively. Each of these motors is connected to lines L31 through L36, respectively, that are connected to one terminal of module control logics CL2 through CL7, respectively.

Each of the module control logics has a terminal that is connected by lines (not numbered) to a line L37 that is connected to AC common line L15. The lines L28 and L37 are connected by lines L38 and L39 to terminals of coin changer 14 to provide AC power to the coin changer. A line L40 connects a terminal of main control logic CL1 to line L37. The light 19 is connected to line L40 and to a coin magnet (not shown) of coin changer 14.

Figure 6A:
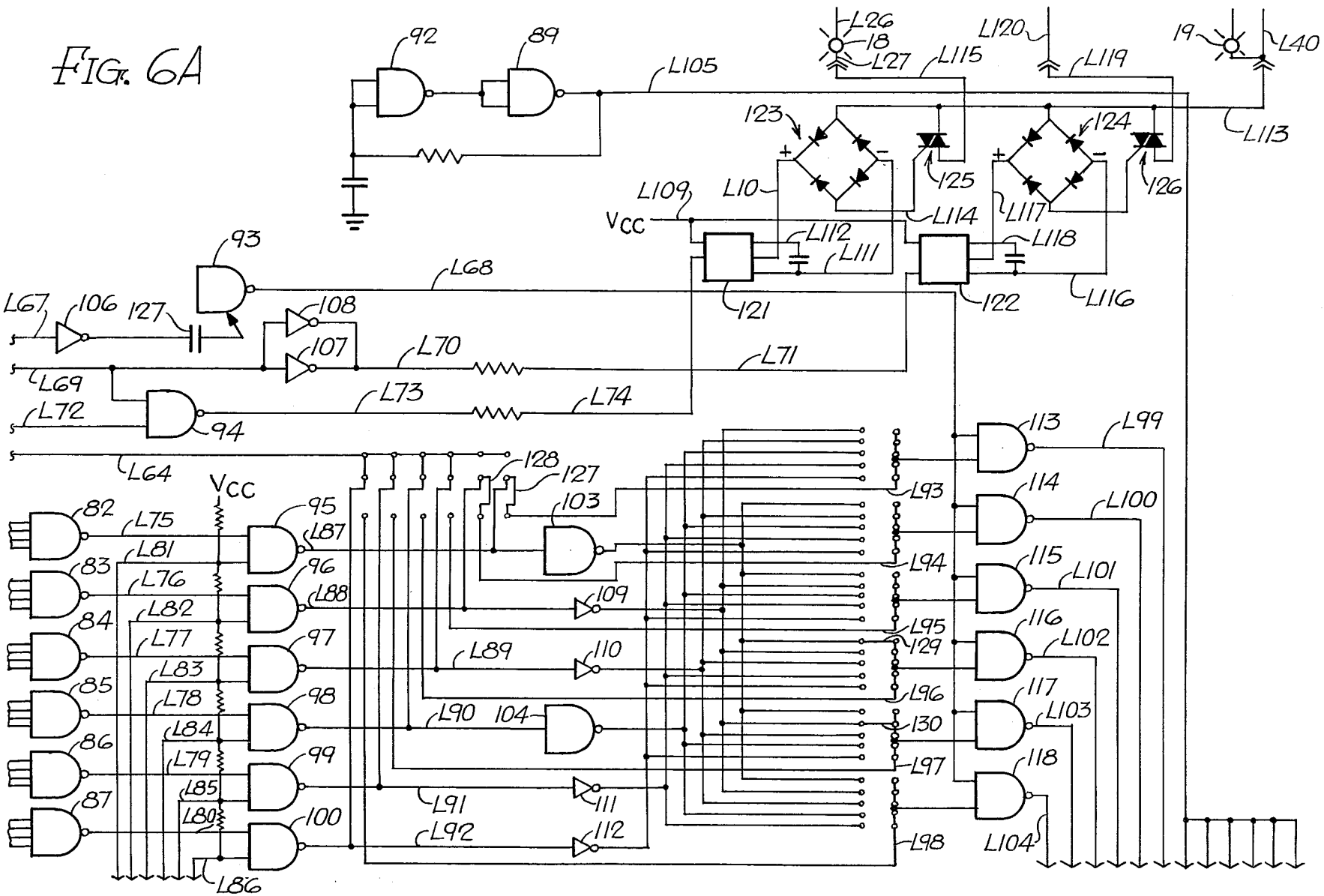

FIGS. 6 and 6A show main control logic CL1, pushbutton switches 21 through 28, various lines to and from the main control logic, other lines to the pushbutton switches or to lights 18 and 19, line L25 connected to AC hot line L16, and line 40 connected to AC common line L15. In the preferred embodiment, that is described, various digital circuits are connected as described below by printed conducting lines on printed circuit board 68 of main control logic CL1. These digital circuits are mounted on board 68. Also mounted on board 68 are various components that have terminals connected to printed conducting lines of board 48 and other terminals that are connected to wires that carry current provided by AC hot and common lines L16 and L15, respectively.

On printed circuit board 68 are mounted isolators 70 through 77. The terminal of each of these isolators, that is connected to the cathode of the light-emitting diode (shown for isolators 70 and 77 in FIG. 6), is connected by a wire, shown as a line (not numbered), to a wire, shown as a line L41 (FIG. 6), that is connected to line L40 (FIG. 5) that provides a connection, by line L37, to line L15. This completes an electrical circuit between lines L15 and L16 through one of isolators 70 through 77 whenever the associated pushbutton switch is closed. This occurs provided there is voltage provided to the associated terminal to coin changer 14. That occurs if the total value of added coins at least equals the total value necessary to provide this voltage at that terminal of coin changer 14.

In addition to the light-emitting diode, each optically coupled isolator of isolators 70 through 77 also includes a phototransistor having an emitter and a collector (shown for isolators 70 and 77 in FIG. 6). Thus each optically coupled isolator has an input connected to the collector of the phototransistor and an output connected to the emitter of that phototransistor.

As mentioned above in the summary of the invention, the networks of the main control logic are provided by sets of lines connected to sets of outputs of the main control logic and an additional set of lines connected to a number of inputs of the main control logic. The programmed connections between the sets of lines and the additional set of lines using certain pairs of pairs of spaced terminals is also described. In the preferred embodiment these sets of lines and the additional set of lines are printed conducting lines on printed circuit board 68. A board (not shown), that is mounted on board 68, has a number of holes through it so that the holes are in alignment with these terminals connected to the sets of lines or to the terminals of the additional set of lines. Thus there are eight vertical rows of pairs of holes in this board mounted on board 68. Adjacent rows of pairs of holes are separated by a vertical rib on the board mounted on board 68. Each vertical row of pairs of holes comprises 24 pairs of holes. A pair of terminals is connected by inserting the connector wires of a diode (illustratively IN497) through one of these pair of holes of the 8 × 24 pairs of holes and these connector wires of the diode are connected to the pair of terminals that are below this pair of holes so that the anode is connected to a terminal connected to one of the lines of one of the sets of lines and the cathode is connected to one of the terminals connected to one of the lines of the additional set of lines.

Mounted on printed circuit board 68 are various gates, flip-flops and inverter gates along with other components. There are 10 NAND gates 80 through 89. These are 4-input NAND gates. In the illustrative embodiment they are provided by five dual 5-input power NAND gates HiNIL 301 sold by Teledyne Semiconductor. This NAND gate is an expandable buffer gate with high drive and sink current. There are 11 2-input power gates 90 through 100. These are provided in this illustrative embodiment by three quad 2-input power gates (passive pullup) sold as HiNIL 303. There are two hex inverter gates (passive pullup) sold as HiNIL 333. Each HiNIL 333 hex inverter gate has four inverters and two gates. These are shown in FIGS. 6 and 6A as inverters and NAND gates but the NAND gates function as inverters. The four NAND gates are gates 101 and 102 (FIG. 6) and gates 103 and 104 (FIG. 6A). The eight inverters are inverters 105 (FIG. 6) and inverters 106 through 112 (FIG. 6A). There is also one HINIL 334 strobed hex inverter (open collector) having gates 113 through 118 (FIG. 6A). The digital circuits HiNIL 303, 333 and 334 are also sold by Teledyne Semiconductor.

Also mounted on printed circuit board 28 are two master/slave flip-flops 119 and 120 (FIG. 6). In the illustration, these are provided by using HiNIL 313 dual J-K master/slave flip-flop (active pullup). Further mounted are two photo silicon controlled rectifiers (SCRs) 121 and 122, two full-wave rectifiers generally indicated at 123 and 124, and two triacs generally indicated at 125 and 126. In this illustration, the photo SCRs are Monsanto's MCS2, the rectifiers are sold as VE28, and the triacs are triacs 40529.

The inputs of the optically coupled isolators 70 through 77, that are connected to the emitters of the phototransistors, are connected to printed conducting lines L42 through L49, respectively (FIG. 6), on board 69. These conducting lines are the additional set of lines, mentioned above. Each of lines L42 through L49 is connected to six spaced sets with four spaced terminals in each set. For example, line L42 is connected to six sets of four terminals. These terminals are shown in vertical array in FIG. 6. Each of the four terminals of the top set is connectable by a diode to a terminal connected to one of four unnumbered printed conducting lines that are connected by a connector (not shown) to the four wires, that are shown in FIG. 5 as a set of four unnumbered lines connecting terminals of main control logic CL1 to terminals of module control logic CL2. Those wires are connected by a connector (not shown) to four printed conducting lines L50 through L53 (FIG. 7) on the printed conducting board 68 of module 31. To these four lines on board 42 are four unnumbered printed conducting lines that are connected to four inputs of NAND gate 82 (FIG. 6A). Similarly, each terminal of the other five sets of four terminals connected to line L42 is connectable by a diode to one terminal each of the set of spaced terminals connected to the other sets of unnumbered conducting lines that are connected by connectors (not shown) and five other sets of four wires, shown in FIG. 5, to lines L50 through L53 on boards 68 of logics CL3 through CL7. To these other sets of conducting lines on board 42 are connected sets of four unnumbered conducting lines that are connected to the four inputs of NAND gates 83 through 87, respectively.

As seen later, the lines L50 through L53 are provided with BCD binary information in which lines L50 through L53 provide the 1, 2, 4 and 8 bits of the BCD value. Thus the uppermost terminal of the set of spaced terminals connected to line L42 would be connected by a diode to the associated terminal of the set of spaced terminals connected to the conducting line that is connected to one input of NAND gate 82 and to the conducting line (FIG. 6) that is connected through, the connector of main control logic CL1, one of the four wires, the connector for module control logic CL2, to line L53. This diode connection is provided if line L53 is to be provided with a low-level signal so that the 8 bit as a high-level voltage signal of the BCD signals to be provided to the D input of the decade counter DC. Of course, this diode connection provides a low-level signal to that one input of NAND gate 82, but only if pushbutton switch 21 is closed by depressing its pushbutton and then only if AC voltage is provided to line L5 by the associated output terminal of coin changer 14.

Similarly, the connection of other pairs of the three pairs of terminals, having one terminal of each connected to line L42 and the terminals connected for each to one of the other three lines of that set of printed conducting lines, can be selectively provided by diodes to provide low-level voltage signals to the other inputs of NAND gate 82 and to provide low-level voltage signals to one or more of lines L50 through L52. Of course, a low-level signal on any of the four conducting lines connected to the four inputs of NAND gate 82 provides a change in the output signal of that gate. However, the nature of the signals in the four lines determines the high-level or low-level voltage signal condition in lines L50 through L53 and thereby determines the voltage levels of input signals to the A, B, D and D inputs of decade counter DC of module control logic CL2.

In view of the foregoing, it is seen that the extent of such diode connections of the four terminals of the first set connected to line L42 determines the voltage levels of the signals provided to the four inputs of decade counter DC of logic CL2. These four terminals connected to line L42 are, therefore, considered to be the 8, 4, 2 and 1 terminals. The construction for the other sets of spaced terminals to line L42 is the same. This is also the case for the six sets of possible diode connections of the 8, 4, 2 and 1 terminals of each of the six sets of spaced terminals connected to lines L43 through L49.

Unnumbered diodes are shown in FIG. 6 connecting selected pairs of terminals, that are connected to lines L42 through L49, to provide certain signals to decade counters DC of selected modules. These connected diodes are provided by a selection based on the denomination of stamps of the rolls 48 of stamps loaded in modules 31 through 36. In this illustration these rolls 48 have stamps with denominations of 1¢, 10¢, 8¢, 1¢, 10¢ and 13¢ for modules 31 through 36, respectively. The diode connections are also determined by the number of stamps of each particular denomination that is to be dispensed when one of the pushbuttons of one of switches 21 through 28 is pressed, if voltage is provided by the associated line of lines L5 through L12. For the BCD signals, to be provided to the inputs of decade counter DC of a specific module, to dispense the correct number of stamps, the connection provided by the diodes is on the basis of providing BCD signals to counter DC of the associated module control logic for an entry of the tens complement of the number of cycles of operation of the module to be completed for the dispensing of the corresponding number of stamps. Thus, for a dispensing of one stamp, diodes are connected to provide high-level voltage signals to the A and D inputs of the decade counter DC to set the decade counter to a count of nine. Then all outputs of that decade counter will provide a low-level voltage signal after one count. This is because the count of nine, that is entered, is provided by the diodes connecting the 8 and 1 terminals, connected to one of the lines of L42 through L49, so that there is a change to a low-level voltage signal in lines L53 and L50 of the module having that decade counter, by the pressing of one of the pushbuttons of one of the associated one of switches 21 through 28.

In view of the foregoing, it is seen in FIG. 6 that the 8 and 1 terminals of line L42 are connected by diodes to the two lines of the set of four lines that are connected to lines L53 and L50, respectively, of logic CL3 of module 32, that is loaded with a roll of 10¢ stamps.

The module 35 is also loaded with a roll of 10¢ stamps, and in this preferred embodiment, module 35 is a backup for module 32. The set of four lines of the conducting lines that are connected to NAND gate 86 and connected to lines L50 through L53 of logic CL6 are shown as being connected in the same manner by diodes to the 8 and 1 terminals of the fifth set of terminals connected to line L42. However, as described later, the momentary closing of pushbutton switch 21 does not result in the entry of BCD signals inverted from those provided in lines L50 through L53 of module CL6 because of other circuitry of main control logic CL1, that prevents a start pulse to logic CL6 and thereby prevents the transfer of BCD signals, in inverted form, from lines L50 through L53 of module CL6 to decade counter DC of module CL6.

As seen from the placement of diodes connecting lines L43 through L49, as shown in FIG. 6, the other combinations of denominations of stamps and numbers of stamps can be provided as shown on panel 11 alongside of pushbutton switches 22 through 28. Thus, the four diodes, that are connecting four pairs of terminals in which one terminal of each pair is connected to line L43, are the diode connections to provide two 1¢ stamps and one 8¢ stamp using modules 31 and 33, with module 34 as a backup for module 31. There is one diode connected to the 8 terminal of the first set of terminals connected to line L43. This diode connection provides, when a low-level voltage signal is provided in line L43, a high-level voltage signal to the D input of counter DC of module 31 to require a count of two in the stamp-dispensing operation of that module to provide two 1¢ stamps. Another diode connects the 8 terminal of the fourth set of terminals connected to line L43 that will similarly provide a low-level voltage signal to the D input of counter DC of backup module 34 if module 31 is "empty" of stamps; otherwise that D input of counter DC of module 34 does not have the BCD signal entered because that module is locked out by the additional circuitry mentioned above. For the third set of terminals connected to line L43, diodes are connected to the 8 and 1 terminals and to the associated terminals that are connected to two lines of four sets of lines that provide BCD signals to counter DC of module 33, whereby that module is operated to dispense one 8¢ stamp. This is because these two diode connections enter a count of nine in that counter.

The pattern of connections of the other diodes shown in FIG. 6 to provide the proper dispensing of stamps of specific denominations in accordance with the indicia on panel 11 alongside of the buttons of pushbutton switches 23 through 28 will be apparent from the foregoing description.

Each of lines L42 through L49 has a high-level voltage so long as current does not flow through the diode of the optically coupled isolator to which the line is connected. The lines L42, L44, L46 and L48 are connected to a set of printed conducting lines L50, L51, L52 and L53 on board 42. The lines L43, L45, L47 and L49 are connected to a set of printed conducting lines L54, L55, L56 and L57 on board 42. The lines L50 through L53 are connected to inputs of NAND gate 80 and lines L54 through L57 are connected to inputs of NAND gate 81. So long as there is a high-level voltage in lines L42 through L49, the outputs of gates 80 and 81 are at the low-level voltage.

Whenever one of optically coupled isolators 70 through 77 has current flowing through its diode, the associated line of lines L42 through L49 changes from a high-level voltage to a low-level voltage. This current flow through the diode occurs if the switch, of switches 21 through 28, associated with that isolator is closed and AC voltage is in the line of lines L5 through L8 that is connected to that switch. This results in a low-level voltage signal to that input of the inputs of that gate, of gate 80 or gate 81, that is connected by one of lines L50 through L57, to the line, of lines L42 through L49, that changes from a high-level to a low-level voltage signal. If that line to one of the inputs is a line connected to gate 80, its output provides a high-level signal to a printed conducting line L58. If it is a line to one of the inputs of gate 81, its output provides a high-level voltage signal to a printed conducting line L59.

The line L58 is connected by printed conducting lines (not numbered) to the emitter of the transistor of each of optically coupled isolators 71, 73, 75 and 77. As a result, none of the transistors of these four isolators can become conducting by closing the associated pushbutton switch even if the line of lines L9 through L12 is provided with voltage, when the line of lines L5 through L8, to which it is connected, is provided with voltage. For example, if the coin changer 14 operates to provide voltage to line L5 and switch 21 is closed for current to flow through the diode of isolator 70, the transistor of isolator 70 becomes conducting so that line 42 is changed to the low-level voltage. This results in a low-level voltage signal by line 50 to one input of gate 80 so that its output provides a high-level voltage signal by line L58 and thence to unnumbered lines to the emitter of the transistor of isolator 71 so that it cannot become conducting by closing switch 22 while switch 21 is closed. At the same time, the emitters of the transistors of isolators 73, 75 and 77 are provided with high-level voltage from the output of gate 80 so that they cannot become conducting to change the voltage level in any one of lines L45, L47 and L49 if one closes any one of switches 24, 26 or 28, even though lines L6, L7 and L8 may be provided voltage from coin changer 14. The same locking out of isolators 71, 73, 75 and 77 is provided by the closing of one of switches 23, 25 and 27. Also, this locking out of isolators is provided to lock out all of isolators 70, 72, 74 and 76 when the transistor of one of isolators 71, 73, 75 and 77 becomes conducting by the closing of one of switches 22, 24, 26 and 28 to provide current flow through one of these isolators. This occurs because the output of gate 81 is connected to the emitters of the transistors of isolators 70, 72, 74 and 76.

The momentary closing of any one of switches 21, 23, 25 and 27 to provide a change in the voltage level of the associated line of lines L42, L44, L46 and L48 does not prevent, by main control logic CL1, a change in voltage level in the other three of these four lines if associated push-button switch is depressed while the first switch is still depressed. Then there is current flow through two terminals of coin changer 14 instead of one. The logic included in the coin changer is constructed so that, if this happens, output voltage at three terminals is turned off. The only terminal at which voltage remains is the terminal connected to the pushbutton switch that was closed first. The stamp-dispensing machine will continue to operate. If a customer simultaneously closes two switches of switches 22, 24, 26 and 28, the coin changer's logic will cease voltage at all terminals.

A line L58 is connected to the input of inverter 101 and a line L59 is connected to the input of inverter 105.

The outputs of inverters 101 and 105 are connected to the inputs of 2-input power gates 90 and 91 and of inverter 102 by unnumbered printed conducting lines. The output of inverter 102 is connected to one input of NAND gate 88 by a printed conducting line L60 while the output of inverter 90 is connected to the second input of NAND gate 88 by a line L61. An unnumbered printed conducting line connects line L61 to the clock input of flip-flop 119, that has its reset input connected by a printed conducting line L62 to the output of inverter 91. The Q output of flip-flop 119 is connected by a printed conducting line L63 to the third input of NAND gate 88. A printed conducting line L64 is connected to the fourth input of NAND gate 88. The output of NAND gate 88 is connected by a printed conducting line L65 to the set input of flip-flop 120. A printed conducting line L66 connects the input of flip-flop 120 to line L62 so that flip-flops 119 and 120 are reset at the same time. The Q output of flip-flop 120 is connected by a printed conducting line L67, that is connected to inverter 106 (FIG. 6A), having its output connected to a capacitor 127 that is connected to the expander input of 2-input power gate 93. These connections are also by printed conducting lines (not numbered) on board 42. The output of gate 93 is connected by a printed conducting line L68, that is connected to one input of gate 118. Unnumbered printed conducting lines connect line L68 to one input each of gates 113 through 117.

The $\overline{Q}$ output of flip-flop 120 is connected by a printed conducting line L69 to the input of inverter 107, that has its output connected to a printed conducting line L70, that is connected through an unnumbered resistor to a printed conducting line L71. The inverter 108 is connected to lines L69 and L70 in parallel with inverter 107. The line L71 is connected to the cathode terminal of the diode of photo SCR 122.

A printed conducting line L72 connects the second input of gate 94 to line L63 (FIG. 6) and thereby to the Q output of flip-flop 119. The output of gate 94 (FIG, 6A) is connected by a printed conducting line L73 to an unnumbered resistor that is connected by a printed conducting line L74 to the cathode terminal of the diode of photo SCR 121.

The outputs of gates 82 through 87 are connected by printed conducting lines L75 through L80 to one input of 2-input power NAND gates 95 through 100, respectively. A set of six printed conducting lines L81 through L86 are connected to the second output of gates 95 through 100, respectively. The lines L81 through L86 are connected by a connector to wires. Each of the wires extends to a different module control logic. Each is a wire to a pair of the pairs of wires, that, as shown in FIG. 5, extend to different logics CL2 through CL7 and from each module extends a wire to connect the associated line of lines L81 through L86 to stamp-sensing switch SW1 of the module having that module control logic. Thus, a line of lines L81 through L86 is provided a low-level voltage if there are sufficient stamps remaining in that module to prevent arm 54 being moved by the button of switch SW1 into the annular recess of cylindrical guidance roller 50. In that case button 53 is depressed. Whenever the last stamp of a roll 48 passes beyond roller 50, arm 54 is moved and button 53 is no longer depressed. This results in a change in the associated one of lines L81 through L86 to a high-level voltage signal.

The outputs of gates 95 through 100 are connected by printed conducting lines L87, L88, L89, L90, L91 and L92 to the inputs of inverters 103 through 112, respectively. Mounted on printed circuit board 42 are three rows of spaced terminals. One row is connected to line L64 that is connected to the third input of gate 88 (FIG. 6). The second row is connected to a set (unnumbered) of six printed conducting lines. Each of these unnumbered lines is connected to a different one of lines L87 through L92. If none of the modules is to be a backup for another module, each terminal of the second row is connected by a jumper (not numbered) to a different one of the terminals connected to line L64. In the event that one module is to function as a backup for another module, the terminal of the second row, that is connected to the line of lines L87 through L92, associated with that module is not connected by a jumper to an associated terminal of the first row of terminals that are connected to line L64. Instead, that terminal of the second row is connected by a jumper to the associated terminal of the third row. In FIG. 6, four jumpers connect certain terminals of the second row to associated terminals of the first row but two of the terminals of the second row are connected by jumpers to associated terminals of the third row. In this illustration module 35 is a backup for module 31 and module 36 is a backup for module 32.

Also mounted on board 42 are two rows, each having six sets of five terminals to provide 30 pairs of jumpers with the terminals of each pair being selectively connectable by jumpers. The five terminals of each of the six sets of a first row are connected to a different conducting line. These lines are lines L93 through L98, that are connected to different terminals of the third row of terminals mentioned above. These lines are connected also to unnumbered lines connected to the data input of strobed inverters 113 through 118, respectively, each of which has its strobed input connected to line L68 as described above.

The terminals of the five terminals of the six sets of the second row are connected to other printed conducting lines on board 42 that have a pattern as shown in FIG. 6A. By this pattern of printed conducting lines the output of NAND gate 103 is connected to one only of the five terminals of only five sets of the second row. These terminals are connectable by jumpers to terminals of the first row with which they provide pairs of terminals and thereby to lines L94 through L98. The output of each of inverters 109 and 110, gate 104, and inverters 111 and 112 are similarly connected to one terminal only of each five sets of terminals that are connectable to terminals of the first row with which they provide pairs of terminals and thereby to five of lines L93 through L98. It is seen in the foregoing that the output of gate 103, which has its voltage signal affected by switch SW1 of module 31, is connectable by a jumper to any one of gates 113 through 118, except gate 113, so the one gate of these gates, that is selected by a jumper connection, is provided a proper voltage signal to the data input of that gate to enable that gate to change the output signal to provide a pulse to permit entry into the control logic of the associated module based on the binary information provided on the sets of four lines connected to the same line of lines L42 through L49 by diodes to that associated module. Thus, diodes, that are the backup set of one or more diodes, are connected in the same pattern as the diodes for the module that becomes inoperative when it becomes "empty" of stamps. In addition to this connection by a jumper, it is necessary to place a jumper to connect a specific terminal of the second row of the three rows of terminals to the associated terminal of the third row rather than to the associated terminal of the first row.

The foregoing use of jumpers connecting terminals, providing pairs of terminals of the two rows of terminals having six sets of five terminals for each set, is illustrated in FIG. 6A. In that case, the fourth and fifth modules, namely, modules 34 and 35, are backups for the first and second modules, namely modules 31 and 32. In this use the terminals of the second row, of the three rows of terminals, that are connected to lines L89 through L92 and thus are associated with modules 33 through 36, are connected by jumpers to the associated terminals of the first row, of the three rows of terminals, and are connected to line L64. The other two terminals of the second row of the three rows of the terminals are connected by jumpers 127 and 128 to the associated terminals of the third row of terminals and thereby connect lines L87 and L88 to lines L93 and L94 that are connected to the data inputs of gates 113 and 114, respectively. These data inputs of gates 113 through 118 are enable inputs for those gates. In the absence of a jumper from a terminal of the second row to a terminal of the third row the data inputs to gates 113 through 118 are provided with a high-level voltage signal so that the outputs can provide a low-level pulse to lines L99 through L104, whenever a high-level pulse is provided in line L68.

The presence of jumpers 127 and 128 do not change the enable signal from a high-level voltage signal so long as lines L81 and L82 provide a low-level signal to gates 95 and 96. Each of lines L81 through L86 is provided a low-level voltage signal by switch SW1 of the associated module of modules 31 through 36, respectively, so long as the associated module is not "empty" of stamps.

When one of the modules is "empty" of stamps, switch SW1 of that module operates to provide a high-level voltage signal to the associated line of lines L81 through L86. This changes the output signal of the associated gate of gates 95 through 100 to provide to line L64 a change to a low-level voltage signal, if a jumper connects line L64 to the line of lins L87 and L92 associated with that module, and if the associated gate of gates 82 through 87 has its output changed to a high-level voltage signal by the selective closing of the associated switch of switches 21 through 28. As a result, the output of NAND gate 88 (FIG. 6) will not change its output signal from a high-level voltage signal to a low-level voltage signal to line L65 to set flip-flop 120 that is necessary to provide the high-level pulse in line L68 to start the operation of that module, of modules 31 through 36, that is "empty" of stamps and any other module to be operated by the selective closing of that pushbutton switch. That required change in the voltage level of the output of gate 88 occurs when there is a high-level voltage signal in lines L60, L61 and L63 as a result of a change in the output signal of NAND gate 80 or 81 resulting from a change to a low-level voltage signal in one of lines L50 through L56. It is seen that if one of the modules 31 through 36 becomes "empty" of stamps the stamp dispensing machine will become inoperative, when there is a selection that requires the operation of this module, alone or in combination with one or more other modules, unless this module is backed up by another module that still has sufficient stamps.

For the use of one of the modules as a backup of another module, the module that is backed up does not have its switch SW1 connected by a jumper connecting the associated terminal of the second row of the three rows of terminals to the associated terminal connected to line L64. This is the case in the illustration in which modules 31 and 32 are backed up. Thus, when either one of these two modules does not have sufficient stamps, the signal in line L64 does not change; however, that module becomes inoperative. For example, if module 31 is empty, the connection of line L87 to line L93 by jumper 127 changes the enable input signal to gate 113 so that a pulse to gate 113 does not provide a pulse to line L99 that is required to initiate the dispensing operation of module 31. The same result is obtained for module 32 if it becomes, "empty" of stamps, because then there the signal change in line L88 is provided to gate 114 by jumper 128 and line L94. The gate 114 is no longer enabled.

As seen in FIG. 6A, there is a jumper 129 that is connected to a terminal, of the five terminals of the first of the two rows of the terminals, that is connected by line L96 to enable input of gate 116. The jumper 129 connects this terminal to that terminal, of the five terminals of the six sets of terminals of the second row, with which it is associated as a pair. That terminal of the second row is connected by printed conducting lines of the pattern of printed conducting lines so that line L96 and thereby the enable input of gate 116 is connected to the output of gate 103. So long as module 31 has sufficient stamps, line L87 has a high-level voltage signal so that the output of gate 103 is a low-level voltage signal. During this condition of module 31, therefore, the data input of gate 116 through jumper 129 is provided a low-level voltage signal. As a result gate 116 is not enabled. Accordingly, module 34 is not provided a low-level voltage pulse, that is necessary to initiate its operation, when a high-level pulse is provided to line L68. This prevents the operation of module 34 even though the same binary information is provided to module control logic CL5 of module 34 by the fourth set of four lins as a result of the two diodes connecting line L44 to two lines of that fourth set of lines as binary information provided by the two diodes connecting line L44 to two lines of the first set of four lines connected to module control logic CL2 of module 31. That binary information to modules 31 and 34 is provided when pushbutton switch 23 is momentarily closed, if line L6 is provided voltage by the associated terminal of coin changer 14. Similarly, the effect of backup diodes connected to lines L43, L45, L47 and L48, that provide a change in the binary information to logic CL5 through the fourth set of four lines, cannot be entered in logic CL5, to determine the number of stamps to be dispensed and thereby initiate the operation of module 34, because no low-level pulse is provided to the output of gate 116 when its strobed input receives a high-level pulse from line L68.

When module 31 becomes "empty" of stamps, the enable input of gate 113 becomes a low-level voltage signal. Then gate 113 is no longer enabled to provide a low-level pulse to line L99. This occurs because the enable input of gate 113 is connected by line L93, jumper 127 and line L87 to the output of gate 95 that changes to a low-level voltage signal. When the output of gate 95 changes to the low-level voltage signal, this changes the output of gate 103 to a high-level voltage signal. That signal change is provided to the enable input of gate 116. As a result, a low-level pulse is provided by gate 116 to line L102 when there is a pulse provided by line L68. This pulse in line L102 initiates the operation of module 34 to dispense stamps, in a number based on the binary information provided by the fourth set of four lines connected by one or more backup diodes that are connected to one of eight lines L42 through L49 that has had a change to a low-level voltage signal.

The gate 117 similarly has a low-level signal provided to it by a jumper 130 connecting that enable input through a pair of terminals, of the five pairs of terminals of the fifth sets of five terminals of the six sets of terminals, to the printed conducting lines, of the pattern of conducting lines that connect to the output of inverter 109 having its input connected to line L88. That output of gate 109 changes to a high-level voltage signal when the input of inverter 109 is provided the low-level signal in line L88 that results, through jumper 128 and line L94, in the disabling of gate 114. Thus, gate 117 is enabled when gate 114 is no longer enabled. As a result, the pulse in line L68 results in a required low-level pulse in line L103, that is connected to logic CL6 of module 35 so that it can enter binary information from the fifth set of four lines in accordance with the back diodes connecting those lines to the appropriate one of lines L42 through line L49 that becomes conducting.

The gate 92 has its two inputs connected to an unnumbered capacitor that is connected to ground. The output of gate 92 is connected to the two inputs of fgate 89 that has its output connected to a line L105 that is connected by an unnumbered resistor to a line connecting the capacitor to the line connecting the two inputs of gate 92 to the unnumbered capacitor. These lines are printed conducting lines on board 42. Five unnumbered printed conducting lines are connected to line L105 and these six lines extend to one margin of board 42 where they are connected to a connector (not shown) by which they are connected to six wires. Each of these six wires extends to a different connector of the connectors that connect them to control logics CL2 through CL7 to provide a signal to a line L106 (FIG. 7) that is used for each module control logic to provide a reset signal for its decade counter DC, as described later, after power is restored, after it is lost for some reason. These six wires are one wire each of the pairs of wires between logic CL1 and logic CL2 through CL7, mentioned earlier in the description of the six wires that connect lines L99 through L104 to module control logics CL2 through CL7, respectively. Each of the latter wires is connected by a conductor to a printed conducting line L108 (FIG. 7) on board 68 of one of the logics CL2 through CL7.

The line L74 (FIG. 6A) is connected to the cathode of the diode of photo SCR 121 as described earlier. This diode is the light-emitting diode. The anode of that diode is connected by an unnumbered printed conducting line to a printed conducting line L109 that is connected to line L23 (FIG. 5), that is also on board 42. The photo SCR 121 includes this diode and a PNPN photo SCR that is a diode having a cathode, an anode and a gate and that becomes conducting when current flows through the light-emitting diode to provide infrared radiation to the photo SCR. A line L110 is connected to the anode of the photo SCR. A line L111 is connected to the cathode of the photo SCR. The gate of the photo SCR is connected to a line L112 that is connected by an unnumbered capacitor to line L111. The lines L110 and L111 are connected to the (+) and (−) terminals, respectively, of rectifier 123. One of the other two terminals of rectifier 123 is connected by line L113 that is a wire connected to line L40, that is connected by line L37 to AC common line L15. The fourth terminal of rectifier 123 is connected by a line 114 to the gate terminal of triac 125. One main terminal of triac 125 is connected by an unnumbered line to line L113 and thus to the AC common line, while the other main terminal is connected by a line L115 that is connected through light 18 to line L26 that is connected (FIG. 5) by line L28 to AC hot line L16.

The line L71 (FIG. 6A) is connected to the cathode of the light-emitting diode of photo SCR 122 that has its anode connected to line L109. Lines L116 and L117 are connected to the cathode and anode of the photo SCR of photo SCR 122 with the gate connected by a line L118 and through an unnumbered capacitor to line L116. The lines L116 and L117 are connected to the (−) and (+) terminals, respectively, of rectifier 124. One of the other two terminals of rectifier 124 is connected to line L113 while a fourth terminal is connected to the gate terminal of triac 126 that has one main terminal connected to line L113 and the other main terminal connected by a line L119 to a connector that connects to another line L120, that also is a wire, to the coin magnet of coin changer 14. Of course, there are six lines L120 with each wire coming from a different module and these are connected to a connector that provides a single line to a coin magnet. As seen in FIG. 5, light 19 is connected by lines L40 and L37 to AC common line L15 and light 19 has its other contact connected to coin changer 14. In the event that the coin or coins introduced into coin slot 12 would require a return of change and the nickel and dime coin tubes are empty, the logic of coin changer 14 closes a switch to turn on light 19.

For simplification, it is assumed for the following description of operation that a customer selects one of eight selections to dispense stamps only from one module. An example is the selection of five 10¢ stamps, that is made by pressing the button of pushbutton swithc 25 (FIG. 1). It is also assumed that this module has sufficient stamps to dispense five stamps after its operation is initiated by the closing of switch 25.

As mentioned earlier, the six modules 31 through 36 include logics having the same construction. FIG. 5 shows the construction for logic CL2, with the associated components including motor M1, LED 41, switches SW1 and SW2, circuit breaker CB1 and decimal counter 69, of module 31. Mounted on printed circuit board 42 of logic CL2 are various gates and a decade counter along with resistors, capacitors, and photo SCR optoisolator (Monsanto's MCS2), full-wave rectifier (V528), and a triac (40529). There are two hex inverter gates (HiNIL 333) to provide gates 131 through 142. There are four NAND gates 143 through 146 that illustratively are provided by a quad 2-input NAND gte HiNIL 321. The illustrative decade counter is HiNIL 371 decade counter.

The lines L50 through L53 (FIG. 7) are connected to the four printed conducting lines of the first set of six sets of four printed conducting lines (FIG. 6) on board 68, as described earlier. The lines L50 through L52 are connected to the inputs of inverters 131 through 133 respectively, that have their outputs connected to printed conducting lines L121 through L23, respectively. The line L53 is connected to two inputs of gate 134 so that it has an inverter and the output of gate 134 is connected to a printed conducting line L24.

The line L108, that is connected to line L99 (FIG. 6A) on board 68, as described earlier, is connected to two inputs of gate 135 and two inputs of gate 138 so that they function as inverters. The line 108 is connected also to the inputs of inverters 136 and 137. The outputs of gate 135, inverters 136 and 137 and gate 138 are connected to lines L125 through L128, respectively.

The external connection of gates 134 and 135 are wired AND so that the logic level in line L124 is a high-level signal only in the outputs of gates 134 and 135 are at a high-level voltage. The inverters 133 and 136 are similarly connected, as are inverters 132 and 137, as well as inverter 131 and gate 138. In view of these wired AND connections, one or more of lines L121 through L128, that are connected to the A, B, C and D inputs of decade counter DC, a high-level voltage signal at any one of the outputs of inverters 131 through 133 and gate 134 will not be provided to these inputs of counter DC until a high-level pulse is provided by the outputs of he corresponding one of gates 135 and 138 and inverters 136 and 137, respectively. All of the latter four outputs provide this pulse at the same time. This occurs when there is the low-level pulse provided by the output of NAND gate 113 (FIG. 6A).

Ordinarily, lines L50 through L53 provide a high-level voltage signal. Thus each of the outputs of inverters 131 through 133 and gate 134 provides a low-level signal. Accordingly, each of lines L121 through L124 ordinarily provides a low-level signal to the four BCD inputs of counter DC. When one or more of lines L50 through L53 changes to a low-level voltage signal, as a result of current flowing through one or more of the diodes connecting the four lines of the first set of one of lines L42 through L47, that occurs when the associated transistor of one optical isolators 70 through 77 becomes conducting, the output of the corresponding inverter or gate, of inverters 131 through 133 and gate 134, is changed to a high-level voltage signal. This does not change the input to the associated input of counter DC until there is a low-level pulse provided by line L108 to provide high-level pulses to the outputs of gates 135 and 138 and inverters 136 and 137. When the latter condition is obtained from circuitry of FIGS. 6 and 6A, the change in the binary information is entered at the inputs of counter DC. This provides the corresponding change at the four outputs of counter DC. This is an entry of a count representing the BCD information corresponding to the pattern of connection of diodes for the first four lines of the six sets of four lines and is provided by closing momentarily the appropriate pushbutton switch of switches 21 through 28.

This entry of a count is illustrated by referring to FIG. 6. Assuuming that 10¢ has been added to slot 12 and switch 22 is momentarily closed, transistor of isolator 71 becomes conducting. For the first four lines of the first set of the six sets of four lines there is only one diode connecting line L43 to one of these four lines. It is connected to the first of these four lines that is an 8 and thus there is only one entry of a pulse to counter DC. It is provided by the high-level pulse in line L124. This sets the decade counter to a count of 8 so that two counts are necessary to count to 10, i.e., to return the counter to a count of zero. In the illustration module 31 is loaded with 10¢ stamps and it is noted that the operation of the machine by closing pushbutton switch 22 is indicated on panel 11 (FIG. 1) as providing an oepration to dispense two 1¢ stamps.

This entry to a count of 8 for decade counter DC changes the output signal of one of four BCD outputs of counter DC. These A, B, C and D outputs are connected to lines L129 through L132. The lines L129 through L131 are connected to the inputs of inverters 139 through 141 and the line L132 is connected to both inputs of gate 142 so that it functions as an inverter.

Normally, the BCD outputs of counter DC provide a low-level voltage signal. When a count, that is then tens complement of the number of stamps to be dispensed, is entered into counter DC, one or more of the BCD outputs are provided with a high-level voltage signal. For example, in the foregoing illustration for the count of 8 line L132 is provided with a high-level voltage signal.

The inverters 139 through 141 and gate 142 are wired AND, so that a line L133 connected to their outputs has a high-level signal until one or more of the BCD outputs of counter DC provides a high-level voltage signal to the associated inverter or gate of inverters 139 through 141 and gate 142. When there is a change to a low-level voltage signal on line L133, motor M1 of module 31 starts operation as described earlier. During its operation, for each stamp dispensed, the count of one is provided to counter DC. The operation of motor M1 continues to provide counts until counter DC returns to a count of zero, that results in a change in line L133 to a high-level voltage signal that results in turning off motor M1.

In the event that power to the stamp dispensing machine, i.e., stamp vending machine, is turnned off, it is necessary, necessary to reset counter DC; otherwise, the counter will undesirably initiate the operation of motor M1 to initiate the operation of motor M1 to initiate a dispensing of stamps. Accordingly, line L107, mentioned earlier, is connected to the two inputs of gate 143 that has its output connected by a lin L134 to the four reset inputs of counter DC to reset it when power is restored.

The voltage level on line L133 determines whether motor M1 operates or does not operate. This is because line L133 is connected by an unnumbered resistor, mounted on printed circuit board 68, to a line L135, that is connected to the cathode of the light-emitting diode of photo SCR optoisolator 147, that is also mounted on board 68 of module 31. The anode of that diode is connected to a line L136 that is connected (not shown) by a line L136′ to to unnumbered lines that are connected to two wires (not shown), that extend from board 68 of module 31 to board 42 where they are connected to lines L23′ and L23″, to provide line L136 ith $V_{CC}$ voltage. This $V_{CC}$ voltage is provided also to other lines on board 68 of module 31, that are shown in FIG. 7 as connected to lines L50 through L53 and to line L108 as well as to other lines mentioned later and, of course, to various components such as gates, inverters and the decade counter mounted on board 68. The other five wires (not shown), that connect printed conducting lines on board 68 of the other five modules, are connected to the other lines of L23′ and L23″. When there is a high-level voltage on line L133 the light-emitting diode of photo SCR optoisolator 147 is not conducting. This is the normal condition, i.e., the condition when the stamp dispensing machine is not being used, because the BCD outputs of counter DC are at a low level until a count is entered.

When at least one of the four lines, of the first set of six sets of four lines (FIG. 6), is changed by the change in the voltage level in that line of lines L42 through L49 connected by a diode to that line of the four lines and as a result a low-level pulse is provided to line L108 (FIG. 7), a tens complement of a number of stamps to be dispensed is entered in BCD form in counter DC. The signal in line L133 changes to a low-level signal, because at least one of BCD outputs is changed to a high-level voltage signal. The light-emitting diode of photo SCR optoisolator 147 becomes conducting. The PNPN photo SCR, that is a diode having a cathode, an anode and a gate, of optoisolator 147 becomes conducting when current flows through the light-emitting diode. A line L137 is connected to the anode of this photo SCR. A line L138 is connected to the cathode of this photo SCR. The gate of this photo SCR is connected to a line L139 that is connected by a capacitor to a line L140, that is connected to a line L138.

The lines L137 and L138 are connected to the (+) and (−) terminals, respectively, of a rectifier generally indicated at 148, that is mentioned as one of the components mounted on board 68 of each module 31 through 36. One of the other two terminals of rectifier 148 is connected by a line L141 to line L39 (FIGS. 5 and 7) that is connected to motor M1. The fourth terminal of rectifier 148 is connected by a line L142 to the gate terminal of a triac generally indicated at 149 that is mounted on board 68. One main terminal of triac 149 is connected to line L31 and the other main terminal is connected by a line L143, that is connected to three unnumbered printed conducting lines, also printed conducting lines on board 68, that are connected to three wires (shown as line L37 in FIG. 5) connected to AC common line L15. The other terminal of motor M1 is connected to a line L144 that is connected to the first normally closed switch connected to line L28 is also connected to the first switch of the other five circuit breakers CB2 through CB6 (FIG. 5). These six circuit breakers are connected by line L28 to AC hot line L16. In FIG. 7 there is shown three lines connected by line L28 to the first switch of circuit breaker CB1. This is because line L28 to line L16 is actually three wires to reduce the current load for each wire permitting the use of flat-ribbon-wire assemblies instead of the more labor-intensive cable harness normally employed for wiring.

The circuit breaker CB1 has two other switches. The first one is a second normally closed switch and the other is a normally open switch. This second normally closed switch of circuit breaker CB1 has one contact connected to a line L145 that is connected by a wire to line L81 (FIG. 6A) on printed board 48. There are five wires similarly connecting lines L145 of boards 68 of modules 32 through 36 to lines L82 through L86 on board 42. These six wires are one each of the six pairs of wires shown in FIG. 5 connecting module CL1 to the different logics LC2 through CL7. The other contact of the pair of contacts of this second normally closed switch of circuit breaker CB1 is connected by a line L146 to a fixed contact of switch SW1 that has its moving contact in engagement with this fixed contact when arm 54 is engaged by a stamp so that arm 54 depresses button 53. The other fixed contact of switch SW1 is connected to a line L147. The moving contact of switch SW1 is connected by a line L148 to an unnumbered capacitor and to three unnumbered lines that are connected to ground. The other plate of that unnumbered capacitor is connected by line L149 that is connected to line L136'0 that is connected to the $V_{CC}$ voltage supply, as described earlier.

The line L147 is connected to line L4 that is connected to LED 41 and thus to line L4' (shown also in FIG. 5). Actually, line L4' is a wire connected to LED 41 that is connected to a printed conducting line on board 68 to which is connected an unnumbered resistor mounted on board 68. That resistor is connected to printed conducting line L150 on board 68. The line L150 of each of the six modules is connected by a wire to wire L28 that is connected to line L19 (FIG. 5).

Also connected to line L4 is a line L151 that is connected to one contact of the normally open switch of circuit breaker CB1. That normally open switch has its other fixed contact connected by a line L152 to line L48.

A line L153 is connected to the cathode of a diode generally indicated at 150 that has it anode connected to a line L154. The diode 150 is mounted on board 68. The printed conducting line L154 is connected to one of six wires that connect line L154 of each of six modules CL2 through CL7 to a printed conducting line (not shown) that is connected by a LED (not shown) mounted on board 42. That LED on board 42 is connected to line L19 (FIG. 5) by a printed conducting line (not shown). As a result, when any one of the six switches SW1 of the six modules is not operated by arm 54 of the same module because that module becomes "empty" of stamps, the moving contact of that switch SWl moves from the position shown in FIG. 7 to engage the second fixed contact due to the releasing of button 53. As a result, current flows from line L154 through diode 150 to line L153 and thereby through line L140, switch SW1, line L148 to ground. This LED on board 42 is thereby turned on. At the same time, current flows through LED 41 of that module that is "empty" of stamps. The LED on board 42 is on whenever any one of the modules is "empty" of stamps. Thus that LED and the LED for each module provide a double check to indicate that there is a module that may be "empty"

The circuitry containing the normally open switch of circuit breaker CB1 between line L148 and both LED 41 and diode 150 provides a lighting of LED 41 of a particular module and the lighting of the LED on board 42 in the event that there is a tripping of circuit breaker CB1. This occurs even though that module is not "empty" of stamps. When this lighting is discovered, the module is examined. If button 53 is still depressed by the presence of stamps, the maintenance man can merely press the button 40 of circuit breaker CB1. Of course, if that circuit breaker trips again the cause of the short circuit should be investigated and corrected.

When the moving contact of switch SW1 engages the fixed contact connected to line L146 it connects line L81 (FIG. 6A) on board 42 through lines L145, the second normally closed switch of circuit breaker CB1, line L146, switch SW1 and line L148 to ground. Under this condition a low-level voltage signal is on line L81 so that the output of NAND gate 95 is a high-level voltage signal to provide, as described earlier, through jumper 127 a high-level voltage signal via line L143 to the enable input of NAND gate 113. When module 31 is "empty" of stamps the moving contact of switch SW1 no longer engages the fixed contact connected to line L146 and thus line L81 is no longer connected to ground. Then there is a low-level voltage signal in line L81 that is provided to an input of NAND gate 95. As a result, the enable input of NAND gate 113 is no longer provided with a high-level voltage signal. Accordingly, line L99 is not provided a low-level pulse by a high-level pulse in line L68 to effectuate the entry of binary information provided by the four sets of lines of the first set of six sets of four lines (FIG. 6) connected to lines L50 through L53. This makes module 31 inoperative. The module is also made inoperative if circuit breaker CB1 of module 31 is tripped even though line L146 is connected by switch SW1 to line L148.

The line L150 is also connected to decimal counter 69 of module 31. The counter 69 is connected by a line L155 that is connected to the anode of a diode generally indicated at 151. The line L150 is connected to the cathode of a diode generally indicated at 152, that has its anode connected to line L155. The cathode of diode 151 is connected to a line L156 that is connected to one fixed contact of switch SW2, that has its moving contact connected to ground. The other fixed contact of switch SW2 is connected to a line L157 to which is connected also an unnumbered resistor connected to the $V_{CC}$ voltage supply.

An unnumbered line connects line L156 to the cathode of a diode generally indicated at 153, that has its anode connected to a line L158 that is connected to an expander input of gate 144. The diodes 150, 151 and 152 illustratively use diode IN4002 while diode 153 illustratively uses diode IN4448.

The line L157 is connected to one input of NAND gate 145 that has its other input connected by an unnumbered line to the output of NAND gate 144. The output of NAND gate 145 is connected by line 159 that is connected to two inputs of NAND gate 146. A line L160 is connected to line L159. A line L161 is connected to line L160 and two inputs of gate 145. Thus the output of gate 145 is connected to two inputs of gate 144. The line L158 is connected to the expander input of gate 144. The line L160 also is connected to a line L162 that is connected to one clock input of decade counter DC while the other clock input of counter DC is connected by a line L163 to the output of gate 146 that has an expander input connected by a line L164 to an unnumbered capacitor that is connected to ground.

Because of this circuitry between the fixed contacts of switch SW2 and the two clock inputs of counter DC, the voltage levels change in lines L162 and L163 and revert to the original voltage levels for one cycle of operation of switch SW2 that moves its moving contact from engagement with line L157 to line L156 and return. This results in a count of one in decade counter DC. This occurs during the operation of motor M1 to move star wheel 63 one step for the dispensing of one stamp from module 31. While the moving contact of switch SW2 engages the fixed contact connected to line L156, current flows through counter 69 to provide one count in counter 69 that provides a total count of stamps dispensed from module 31 by the dispensing cycles of operation of module 31.

As seen in FIGS. 3 and 4, printed circuit board 68 of each module has an extension that extends beyond support plate 39 when board 68 is mounted on support plate 39. The side of the extension of board 68, that is seen in FIG. 4, has six parllel printed conducting lines with two of the printed lines approximately equal to twice the width of any one of the other four printed conducting lines. The side of the extension that is seen in FIG. 3 has seven parallel printed conducting lines (not shown in FIG. 3). The first four and sixth lines are narrower than the other two lines. The fifth printed conducting line has a width approximately equal to twice that of any one of the first four and sixth conducting lines while the seventh printed conducting line equals approximately three times the width of any one of the first four and sixth lines.

The side of the extension of board 68 that is seen in FIG. 4 has the four narrower printed conducting lines that are end portions of lines L50 through L53. One of the wider printed conducting lines on that side of board 68 is represented by the three numbered lines (FIG. 7) that are connected to line L143, while the other wider line is represented by the three unnumbered lines connected to line L148. On the other side of board 68, the first through fourth and sixth lines are portions of conducting lines L145, L107, L150, L154 and L108, respectively. The fifth conducting line on the extension is depicted as the unnumbered lines connected to line L149 while the widest unnumbered line on this side of the extension is depicted as three unnumbered lines (also shown in FIG. 7) that are connected to line L28. With this construction the various printed conducting lines on board 68, that must be connected to main control logic CL1 and to AC hot line L16 and AC common line L15 have the terminus of each on one side or on the other side of the extension of board 68.

Within housing 10 are mounted six slotted connectors at suitable locations to receive these extensions of these boards 68 of modules 31 through 36 for electrical contact with these six printed conducting lines on one side of seven printed conducting lines on the other side of the extension. Of course, attached wiring extends from each slotted connector to connectors providing electrical connection between these wires and printed conducting lines on main control logic CL1 to lines L15 and L16. Thus, the stamp vending machine is easily assembled. Each module is easily replaced or slid temporarily from position to provide it with a new row of stamps and then returned to locked position. The only change in the operation of the dispensing program is made by change in diodes connecting lines L42 through L49 to six sets of four lines, each shown in FIG. 6 and described earlier. Of course, if there is a change to provide a backup module or to change a module from its function as a backup module, there is simply a change in the jumper, including jumpers 127 and 128 and a charge for jumpers illustrated by jumpers 129 and 130 connecting one or more of lines L93 through L98 to select contacts of the six sets of five contacts, also described earlier. The electrical contact between the slotted connectors and the lines on the extensions of both sides of board 68 is maintained by locking into position retainer bars 38 (FIG. 2).

In the foregoing description there is described the connection of lamp 18 to triac 125, that has its gate terminal connected to one terminal of rectifier 123, that has its (+) terminal connected to the anode of the photo SCR of photo SCR 121, which is more correctly identified as photo SCR photoisolator 121, just as photo SCR 122 is more correctly identified as photo SCR photoisolator 122.

In the event that at least one customer-selected module of modules 31 through 36 is "empty" of stamps and there is no backup module for it, the output of its associated gate of gates 95 through 100 provides a low-level voltage signal. As a result, the change in the Q output signal of flip-flop 119 to a high-level signal provides that signal to one input of gate 94 but the high-level voltage signal at the output of the $\overline{Q}$ output of flip-flop 120 is not changed because there is the low-level voltage signal still provided by line L64 to one input of gate 88. With these two high-level voltage signals provided at the same time to gate 94, the output of gate 94 provides a low-level voltage signal via line L174 to the cathode of the ligh-emitting diode of photo SCR photoisolator 121. That diode becomes conducting so that rectifier 123 become operative so that current flows through the switch, that is triac 125 to turn on light 18. When light 18 is on, the customer is thereby told to make another selection, i.e., operate another appropriate one of pushbutton switches 21 through 28.

If all modules selected by virtue of closing one of pushbutton switches 21 through 28 have stamps, line L64 provides a high-level voltage signal to gate 88. When the other inputs to gate 88 also have the high-level voltage signal, the $\overline{Q}$ output of flip-flop 120 provides a low-level pulse that becomes a high-level pulse to the cathode of light-emitting diode of photo SCR photoisolator 122. As a result, the diode is no longer conducting. The rectifier is no longer operative so that the switch, that is triac 126, is not conducting. This ceases the flow of current via line 120 to the coin magnet of coin changer 14. The coins are relesed to coin collector receptacle 15. The coin changer 14 is then ready for another transaction to receive coins, etc., for the next stamp-dispensing operation.

Each of motors M1 through M6 of modules 31 through 36 is illustratively a shaded-pole single-phase AC induction motor with rotor clutch. The shaft of this motor operates a gear train (not shown) that is a speed reducer having shaft 60 as its output shaft.

In view of the foregoing description of the stamp vending machine of the present invention, that is illustrated by the preferred stamp-dispensing mechanism of the invention of said copending patent application, it is apparent that in the present invention the dispensing cycle is initiated by the action of a coin or by paper currency that energizes an electrical switch through the action of a coin acceptor/rejector or paper-currency acceptor/rejector. During the dispensing cycle the motor, of each module selected for dispensing, operates continuously causing the strip of stamps to move intermittently until a predetermined number of stamps have progressed through the slot of enclosure 52 associated with the operating module for presentation and manual tear-off at a line of perforations. This predetermination is obtained by the programming of main control logic CL1 including the formation of binary information as signals and the transfer of binary information and a start signal to each module control logic associated with the programmed selected dispensing module to operate its motor so that the feed wheel of the module is stepped the number of times for dispensing the programmed number of stamps.

In this preferred embodiment using the stamp dispensing mechanism of said copending patent application, each revolution of the tapered arm 61 step turns star wheel 63 by pin 64 and lobes of star wheel 63 activate switch SW2 at low engagement velocity to prevent troublesome dynamic effects. Each activiation provides a pulse. These pulses are used to count and log the number of stamps that have been dispensed and to determine and control the number to be dispensed from the module during any one transaction. These pulses are counted by a binary counter of the module control logic, that is set by the main control logic to predetermine the quantity of stamps to be dispensed during the transaction. That setting of the binary counter is obtained by the binary information and a start pulse from the main control logic, as described earlier.

The foregoing description has been presented solely for the purpose of illustration and not by way of limitation of the invention because the latter is limited only by the claims that follow.

We claim:

1. A vending machine useful for dispensing stamps from one or more rolls of strips of stamps during a transaction, which comprises:

a housing having a front panel with a number of holes;

money acceptor/rejector means having at least one output terminal to provide a voltage signal in response to a predetermined minimum value of money added to said acceptor/rejector means for a transaction;

a number of manually operated switches electrically coupled to said at least one output terminal of said acceptor/rejector means;

main control logic means mounted within said housing and being constructed to have a first set of outputs to provide selectively a voltage signal at one of said first set of outputs and to have additional sets of outputs to provide, by one or more of each additional set of outputs, binary information as voltage signals;

at least first and second stamp-dispensing mechanisms, as modules, mounted within said housing, each module including:

support means having a portion constructed to support a roll of a strip of stamps for free rotation of the roll about the axis of the roll;

an enclosure mounted on one margin of said support means and spaced from said portion of said support means that rotatively supports a roll of stamps, said enclosure being in alignment with one of said holes of said front panel and said enclosure having a slot for passage of a strip of stamps through said slot of said enclosure;

motor means mounted on said support means and including a motor and an output shaft;

stamp-feeding means mounted on said support means and including a feed wheel that is operatively connected to said output shaft of said motor means and is located between said enclosure and said portion of said supporting means that rotatively mounts a roll of the strip of stamps, said stamp-feeding means being constructed to move the strip of stamps by said feed wheel to and through said slot of said enclosure; and module control logic means mounted on said support means, said module control logic means being constructed with one input and a set of inputs to be responsive to a signal provided to said one input and to signals, providing binary information, to said set of inputs from said main control logic means to initiate the operation of said motor and to stop the operation of said motor;

first set of electrical coupling means, each coupling means of said first set being connected to a different one of said first set of outputs of said main control logic means and to said one input of a different one only of said module control logic means of said modules; and additional sets of coupling means, each set being connected to a different one of said additional sets of outputs of said main control logic means and to said set of inputs of said module control logic means of a different one of said modules, said main control logic means including in its construction a printed circuit board having printed conducting lines comprising:

first sets of lines with the number of sets corresponding to the number of said modules and with the number of lines of each set corresponding to the number of lines required to provide binary information to said outputs of each of said additional sets of outputs to which said lines of each set are connected;

a first additional set of lines corresponding in number to the number of said manually operated switches, each line being connected to a different one of said manually operated switches; and a second additional set of lines, each line being connected to a different one of said first additional set of lines and with said main control logic means being constructed to provide a voltage signal to one of said first set of outputs of said main control logic means based on a voltage signal provided to one of said lines of said second additional set of lines, and said main control logic means further including in its construction:

first sets of spaced terminals mounted on said board, each set of terminals being connected to a different line of said first sets of lines; and second sets of spaced terminals mounted on said board, each set of said second sets being connected to a different line of said first additional set of lines so that each terminal of said second sets of spaced terminals provides with a different one of said terminals of said first sets of terminals a pair of terminals connectable by a diode, whereby the selective connection of pairs of terminals by diodes provides specific binary information as signals to one or more of said additional sets of outputs of said main control logic means when one of said manually operated switches is closed, so that at least one module is operated to dispense stamps in a number in accordance with the binary information provided to said set of inputs of said module control logic means of the module by said main control logic means.

2. The vending machine of claim 1 for its use in which a first and second line of said first additional set of lines are connected by diodes to at least one line, that are the same for each or are different, of the same set of the first sets of lines in which these two lines of said first additional set of lines are connected to two different switches, of said number of manually, operated switches, with both switches being connected to the same output terminal of said acceptor/rejector means, wherein said main control logic includes:

first and second switch means having:

first inputs connected to first and second switches, respectively, of said two manually operated switches;

second inputs, each of said second inputs being connected to a different one of said first and second lines of said first additional set of lines; and outputs;

a first NAND gate having at least two inputs and an output, said two inputs being connected by printed conducting lines on said board to a different one of said first and second lines of said first additional set of lines and said output being connected by a printed conducting line on said board to said output of said second switch means and connected to one line of said second additional set of lines that connects said first line of said first additional sets of lines to one output of said first set of outputs of said main control logic means that is connected by one of said first set of electrical coupling means that is connected to one of said modules to provide a signal to that module to initiate its operation to dispense stamps in accordance with the binary information provided by the closing of said first manually operated switch; and a second NAND gate having at least two inputs and an output, said two inputs being connected by printed conducting lines on said board to a different one of said first and second lines of said first additional set of lines and said output being connected by a printed conducting line on said board to said output of said first switch means and connected to said one line of said second additional sets of lines that connects said second line of said first additional set of lines to said one output, that is connected by said one of said first set of electrical coupling means, that is connected to said one module to provide a signal to that module to initiate its operation to dispense stamps in accordance with the binary information provided by the closing of said second manually operated switch, each of said first and second switch means being constructed so that they are conducting between its said output and its said second input to provide a voltage signal at that second output, when the switch means, to which it is connected, is closed, to provide a voltage signal at said one output of said main control logic means if there is no change in the voltage signal provided at said second input of that switch means by the change in the signal at the ouptut of the NAND gate to which that second input is connected, so that said one output does not provide a signal to operate said one module by the closing of one of said first and second manually operated switches if the other of said first and second manually operated switches is already closed and thereby has provided a signal to operate said one module.

3. The vending machine of claim 1 wherein:

each of said modules includes stamp-sensing switch means mounted on said support means between a mounted roll of a strip of stamps and said feed wheel to be operated by the strip of stamps and to be released, to provide a signal, when not operated by the strip of stamps; and said module control logic means of each module including an output connected to said stamp-sensing switch means to receive that signal;

said main control logic means including:

a number of inputs equal in number to the number of said modules and each of these inputs being connected to said output of said module control logic means of a different module;

gate means providing the connection between said inputs of said main control logic means to said second additional set of lines to said first additional set of lines, said gate means being constructed to prevent a voltage signal from one of said first additional sets of lines from providing a voltage signal to the module to which it is connected when said gate means is provided a signal by the release of its stamp-sensing switch means as a result of not being operated by a strip of stamps.

4. The vending machine of claim 3 in which a first module of said modules is backed up by a second module of said modules, wherein said main control logic means includes:

second sets of lines with the number of sets corresponding to the number of said first sets of lines and with the number of lines of each set corresponding to the number of lines of each set of said first sets of lines, said second sets of lines being connected to said first sets of lines;

a first gate means not being connected to said first input of said main control logic means to prevent the operation of said first module when its stamp-sensing switch means is released;

said first set of lines of said first sets of lines are connected to said fist module;

said first set of lines, of said second sets of lines, that are connected to said first set of lines of said first sets of lines, are connected to second gate means that is connected to said first input of said inputs of said main control logic means, said second gate means being constructed to inhibit, when said stamp-sensing switch means of said first module is released, the signal provided by said first gate means to said first output, of said first set of outputs, connected to said first module;

said second set of lines of said first sets of lines are connected to said second module;

said second set of lines of said second sets of lines is connected to said second gate means, that is further constructed:

to prevent an output signal from said first gate means to said second output, of said first set of outputs of said main control logic means, that is connected to said second module, when said second set of lines of said first sets of lines is provided binary information through diodes connected to that set of lines and to the line of the first additional set of lines that is connected by corresponding diodes to lines of the first set of lines of said first sets of lines;

to permit, when said stamp-sensing switching means of said first module is released, an output signal from said first gate means to said second output, of said first set of outputs, connected to said second module; and to inhibit, when said stamp-sensing switch means of said second module is released, the signal provided by said first gate means to said second output, of said first set of outputs, connected to said second module.

5. The vending machine of claim 3 in which:

said stamp-feeding means of each module includes means connected to said feed wheel and to said output shaft of said motor means, to turn one step intermittently said feed wheel in response to rotation of said output shaft of said motor means, each intermittent step of said feed wheel providing a dispensing of one stamp from said module;

each module includes second switch means mounted on said support means to be operated by said intermittent-turning means to provide a pulse for each step of said feed wheel;

each module control logic means includes:

a printed circuit board mounted on said support means of said module and having printed conducting lines;

binary counter means mounted on said board and having a count pulse input connected to said second switch means, a set of inputs and BCD outputs;

counter-entry means mounted on said board and connected, by printed conducting lines on said board, to said one input and said set of inputs of said module control logic means and to said set of inputs of said binary counter means, said counter-entry means being constructed to be responsive to a signal at said one input of said module control logic means to enter binary information in said binary counter means and thereby to provide signals at said BCD outputs of said counter means in accordance with the binary information, that is provided to said set of inputs of said module control logic means, and third switch means connected, by printed conducting lines on said board, to said BCD outputs of said binary counter means and connected to said motor to start operation of said motor only when there is a signal at any one of said BCD outputs of said binary counter means, based on an entry of binary information to said BCD counter means by the operation of said counter-entry means, and to continue the operation of said motor until the entry of at least one pulse count in said binary counter means from said second switch means results in no signal at any of the BCD outputs of said binary counter means.

6. The vending machine of claim 5 in which:

said binary counter means includes a decade counter having BCD inputs, as said set of inputs of said binary counter means, and has two count pulse inputs;

said counter-entry means includes:

a first set of inverters, mounted on said board, having their outputs connected by a set of printed conducting lines of said printed conducting lines, on said board, to a different input of said BCD inputs of said decade counter and having the inputs of said first set of inverters connected to different inputs of said set of inputs of said module control logic means; and a second set of inverters, mounted on said board, having their outputs connected to a different line of said set of printed conducting lines connected to the BCD inputs of said decade counter and having their inputs connected to said one input of said module control logic means, said first and second sets of inverters being connected so that each combination of the outputs of the first and second inverters connected to the same BCD input of said decade counter results in a NAND function;

said main control logic means being constructed to provide a low-level voltage signal to said second set of inverters and to provide binary information as low-level voltage signals and high-level voltage signals to said set of inputs of said module control logic means as the tens complement of the number of counts programmed for a dispensing operation of that module, based on one or more diodes connecting that set of lines of the first set of lines to that line, of the first additional set of lines, that is connected to the manually-operated switch that initiates the dispensing operation of that module;

said third switch means includes:

a third set of inverters, mounted on said board, having their inputs connected to said BCD outputs of said decade counter, said third set of inverters being connected so that the combination of their outputs results in a NAND function;

a photo SCR optoisolator mounted on said board having a light-emitting diode with its cathode connected to the outputs of said third set of inverters and having a photo SCR having a cathode and anode;

a full wave rectifier having (+) and (−) terminals and third and fourth terminals, said (+) terminal being connected to said anode of said photo SCR and said (−) terminal being connected to said cathode of said photo SCR: and a triac having a gate terminal connected to said third terminal of said rectifier, a first main terminal connected to one terminal of said motor and to said fourth terminal of said rectifier, and a second main terminal connectable to one of two lines of a power source, that is connectable by the other line to another terminal of said motor; and said second switch means includes:

a switch having first and second fixed contacts and a moving contact, said moving contact being moved from said first contact to said second contact and then back to said first contact by one cycle of operation of said intermittent-turning means; and means, mounted on said board, having first and second outputs connected to said first and second pulse count inputs of said decade counter and having a first input connected to said first fixed contact of said switch and a second input connected to said second fixed contact of said switch, so that this movement of the moving contact from the first fixed contact to the second fixed contact and then back to the first fixed contact provides a signal to each of said first and second inputs of said decade counter to provide one count by said decade counter that represents a dispensing of one stamp by the operation of that module.

7. The vending machine of claim 6 wherein:

said money acceptor/rejector means has a number of output terminals and is constructed to provide an AC voltage at one or more of said number of output terminals in response to the total value of money added to said acceptor/rejector means for a transaction;

said number of manually operated switches includes a set of switches equal to the number of output terminals of said money acceptor/rejector means, each of said set of manually operated switches being connected to a different output terminal of said output terminals of said acceptor-rejector means;

said main control logic means includes a set of optically coupled isolators; each isolator providing said connection between a different line of said first additional set of lines and a different one of said set of manually operated switches, and each isolator including a light-emitting diode and a phototransistor with said anode of each light-emitting diode being connected to the associated manually operated switch, with said phototransistor having its collector connected to the associated line of said first additional set of lines, so that one of these phototransistors becomes conducting when the light-emitting diode of the same optical isolator has current flowing through it by the closing of the associated manually operated switch if AC voltage is provided to it by the output terminal of said acceptor/rejector means to which that switch is connected and so that current flows through the associated line of said first additional set of lines to provide a low-level voltage signal in those lines of said first sets of lines, that are connected by diodes to that line of said first additional sets of lines, whereby the outputs of one or more lines of printed conducting lines on the board of the associated module provide high-level voltage signals to said decade counter if there is also a low-level voltage signal provided to said one input of the module control logic of that module from that output of said set of outputs of said main control logic means, that is connected by that line of said second additional set of lines that is connected to that line of said first additional set of lines.

8. The vending machine of claim 7 wherein:

said modules include said first and second modules as at least a part of a set of modules;

said printed circuit board of said main control logic means includes a third additional set of printed conducting lines corresponding in number to the number of optically coupled isolators of said set of isolators, with each line of said third additional set of lines being connected to a different line of the lines, of said first additional set of lines, that are connected to said set of optically coupled isolators;

said gate means of said main control logic includes:

a first NAND gate having a set of inputs with each input connected to a different line of said third additional sets of lines to provide said connection of said gate means to lines of said first additional set of lines;

a first inverter having its input connected to the output of said first NAND gate; second, third and fourth inverters having their inputs connected to the output of said first inverter;

a second NAND gate having first through fourth inputs and an output, said first and second inputs being connected to the outputs of said second and third inverters;

a first flip-flop having its Q output connected to the third input of said second NAND gate, having its reset input connected to the output of said fourth inverter, and having its clock input connected to the output of said third inverter;

a second flip-flop having its set input connected to said output of said second NAND gate, its reset input connected to said output of said fourth inverter, and a Q output connected to said second additional set of lines;

a first set of NAND gates, each having a number of inputs and an output and each gate having its inputs connected by another set of printed conducting lines on said board to a different set of lines of said first set of lines; and a second set of NAND gates, each having an output, a first input connected to an output of a different one of said gates of said first set of NAND gates, and a second input connected to a different input of said number of inputs, of said main control logic means, that are connected to said output of said module control logic means of different modules of said set of modules, each of said outputs of said second set of NAND gates being connected to said fourth input of said second NAND gate, said first and second NAND gates, said first through fourth inverters, said first and second flip-flops, said first and second sets of NAND gates and said inputs connected to said second inputs of said second set of NAND gates being thus connected by printed conducting lines on said board of said main control logic, and each module of said set of modules having its module control logic means constructed to provide a low-level voltage signal to said second input of the associated gate of said second set of NAND gates of said main control logic means when said stamp-sensing switch means of that module is operated by the strip of stamps in that module and to provide a high-level voltage signal to that second input of the NAND gate when that stamp-sensing means is released, whereby said Q output of said second flip-flop provides a pulse to said one input of that module selected for operation, by operating one switch of said set of manually operated switches, to provide, by at least one diode connection, binary information as signals in that set of said set of first sets of lines connected to said set of inputs of that module for a dispensing operation of that module unless said stamp-dispensing means of that module is released to change the output signal from the associated gate of said second set of NAND gates, that is connected to said fourth input of said second gate of said gate means of said main control logic means.

9. The vending machine of claim 8 to provide a multiple choice of the use of one of the modules of said set of modules as a backup for another module of said set of modules, wherein said main control logic means includes;

first, second and third rows of spaced terminals mounted on said board to provide, by the first and second rows of terminals, first pairs of terminals and, by the second and third rows of terminals, second pairs of terminals, with the first row being connected to a printed conducting line connected to said fourth input of said second NAND gate of said main control logic means, and with said second row of terminals being connected by printed conducting lines to said outputs of different NAND gates of said second set of NAND gates to provide, by jumpers connecting terminals of said first pairs, said connection between said fourth input of said second NAND gate and those NAND gates of said second set of NAND gates that are connected at their said second input to modules that are not backed up by another module;

second gate means that includes:

a third set of NAND gates, having a first input, an enable input and an output, said outputs of said set of NAND gates being connected to a different line of said second additional set of lines to provide said connection between said Q output of said second flip-flop and said first set of outputs of main control logic means;

a set of inverters having their inputs connected to different outputs of said second set of NAND gates;

first and second rows of spaced sets of spaced terminals mounted on said board of said main control logic means to provide spaced sets of spaced pairs of terminals selectively connectable by jumpers, each set of spaced terminals of said first row being connected by a different printed conducting line that connects a different one of said enable inputs of said third set of NAND gates to a different one of said terminals of said third row of terminals, and each set of spaced pairs of terminals having a number of pairs of terminals that is one less than the number of said third set of gates;

sets of interconnected printed conducting lines on said board, each set of lines being connected to an output of a different inverter of said set of inverters, and each set of lines being connected to one terminal only of each set of terminals of said second row of spaced sets of terminals other than the set of terminals connectable by jumpers to that set of terminals of said first row, that are connected to said printed conducting line that is connected to that terminal of said third row, that is connectable by a jumper to the terminal of the second row, of said first through third rows of terminals, that is connected to the output of the same NAND gate of said second set of NAND gates which is connected the inverter connected to that set of interconnected lines.

10. The vending machine of claim 8 in which said main control logic means provides means to control the operation of said money acceptor/rejector means for a transfer of received money to collector means of said acceptor/rejector means for completion of the transactional operation of said acceptor/rejector means, wherein said main control logic means includes:

a photo SCR optoisolator having a light-emitting diode, with an anode and a cathode, and a photo SCR having a cathode and an anode;

another inverter having an output and an input;

a printed conducting line on said board connecting the output of said another inverter to said cathode of said light-emitting diode of said photo SCR optoisolator;

a printed conducting line on said board connecting the input of said another inverter to the $\overline{Q}$ output of said second flip-flop;

a full-wave rectifier having (+) and (−) terminals connected to said anode and cathode, respectively, of said photo SCR, having a third terminal connectable to a common line of an AC power source and a fourth terminal; and a triac having its gate terminal connected to said fourth terminal of said rectifier, one main terminal connectable to the common line of the AC power supply and the second main terminal connected to said acceptor/rejector means, whereby the voltage signal from the $\overline{Q}$ output of said second flip-flop, when it is in the reset condition, provides current flow through said triac to operate said acceptor/rejector means to retain money introduced for a transaction until the voltage signal at the $\overline{Q}$ output is changed to its set condition, by the change of the output signal from said second NAND gate to said set input of said second flip-flop, switches off said triac to supply current flow, to cause the money to be transferred to the collection means of said acceptor/rejector means for its completion of the transaction, until said second flip-flop is reset.

11. The vending machine of claim 10 that provides a visual signal to a customer, after a first selection, that the customer should operate a switch of said number of manually operated switches other than the one the customer first operated for the transaction, because the first selection would require the operation of at least one module that has insufficient stamps to be dispensed in accordance with the program required by that selection, said vending machine includes:

a lamp mounted on the front panel of said housing and, when lit, indicates that the customer should make another selection; and said main control logic means includes:

a second photo SCR optoisolator having a light-emitting diode, with an anode and a cathode, and a photo SCR having a cathode and an anode;

another NAND gate having an output and first and second inputs;

a printed conducting line on said board connecting the output of said another NAND gate to said cathode of said light-emitting diode of said second photo SCR optoisolator;

a printed conducting line on said board connecting said first input of said another NAND gate to said printed conducting line connected to said $\overline{Q}$ output of said second flip-flop;

a printed conducting line on said board connecting said second input of said another NAND gate to said Q output of said first flip-flop;

a second full-wave rectifier having (+) and (−) terminals connected to said anode and cathode, respectively, of said photo SCR, of said second photo SCR optoisolator having a third terminal connectable to the common line of the AC power source and a fourth terminal; and a second triac having its gate terminal connected to said fourth terminal of said second rectifier, one main terminal connectable to the common line of the AC power supply and the second main terminal connected to said lamp, whereby, when the high-level voltage signal at the Q output of said first flip-flop is obtained as a result of closing the manually operated switch and a high-level voltage signal remains at said $\overline{Q}$ output of said second flip-flop, because the selected module has its stamp-sensing switch released due to inadequate stamps for dispensing and thus provides a low-level voltage signal to said fourth input of said NAND gate to prevent its providing low-level voltage to the set input of said second flip-flop, and these two high-level voltage signals to the inputs of said another gate provide a low-level voltage signal at the output of said another gate so that current flows through said second triac to turn on said light indicating another selection should be tried.

* * * * *

UNITED STATES PATENT AND TRADEMARK OFFICE

CERTIFICATE OF CORRECTION

PATENT NO. : 4,040,510

DATED : August 9, 1977

INVENTOR(S) : Walter A. Peters et al.

It is certified that error appears in the above-identified patent and that said Letters Patent are hereby corrected as shown below:

Column 1, line 9, "679,025" should read --697,025--.
Line 57, "U. s." should read --U. S.--.
Column 8, line 62, "MI" should read --MO--.
Column 9, line 25, "line 8" should read --line L8--.
Line 46, "elvation" should read --elevation--.
Column 10, line 2, "FIG." should read --FIGS.--.
Line 12, "biased on" should read --biased by--.
Line 49, "plates" should read --plate--.
Column 11, lines 56-57, cancel "Each ..... L3.".
Column 13, lines 9, 13, 62, 63, 64 and 65, "68" should read --42--.
Line 10, "L25" should read --L22--.
Line 58, "40" should read --L40--.
Line 65, "48" should read --42--.
Column 14, lines 1, 33, 34, 38, 40 and 51, "68" should read --42--.
Column 15, line 6, "28" should read --42--.
Line 20, "69" should read --42--.
Column 16, line 15, "A, B, D" should read --A, B, C--.
Column 18, line 28, "42" should read --L42--.
Line 29, "50" should read --L50--.
Column 21, line 45, "lins" should read --lines--.
Column 22, line 42, "lins" should read --lines--.
Column 23, line 25, "back" should read --backup--.
Line 30, "fgate" should read --gate--.
Column 24, line 6, "114" should read --L114--.
Line 52, "42" should read --68--.
Line 59, "gte" should read --gate--.
Line 67, "L23" should read --L123--.
Column 25, line 1, "has" should read --is--.
Line 2, "L24" should read --L124--.
Line 4, "68" should read --42--.
Line 6, "108" should read --L108--.
Line 12, "only in" should read --only if--.

UNITED STATES PATENT AND TRADEMARK OFFICE

CERTIFICATE OF CORRECTION

PATENT NO. : 4,040,510

DATED : August 9, 1977

INVENTOR(S) : Walter A. Peters et al.

It is certified that error appears in the above-identified patent and that said Letters Patent are hereby corrected as shown below:

Column 25, line 22, "he" should read --the--.
Column 26, line 1, "oepration" should read --operation--.
Line 11, "then" should read --the--.
Line 33, "turnned" should read --turned--.
Line 34, cancel ", necessary".
Line 36, cancel "to initiate ..... of motor M1".
Line 39, "lin" should read --line--.
Line 50, "to to" should read --to--.
Line 53, "ith" should read --with--.
Column 27, line 52, "48" should read --42--.
Line 57, "LC2" should read --CL2--.
Column 28, line 1, "L136'0" should read --L136'--.
Column 29, line 62, "parllel" should read --parallel--.
Column 30, line 10, "numbered" should read --unnumbered--.
Line 30, "side of" should read --side and--.
Line 45, "charge" should read --change--.
Column 31, line 61, "activiation" should read --activation--.
Column 35, line 20, "fist" should read --first--.
Column 39, line 33, "stamp-dispensing" should read --stamp-sensing--.
Column 40, line 30, "which" should read --to which--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*